US011293126B2

(12) United States Patent
Park et al.

(10) Patent No.: US 11,293,126 B2
(45) Date of Patent: Apr. 5, 2022

(54) LAUNDRY TREATING APPARATUS AND WATER SUPPLY CONTROL METHOD THEREOF

(71) Applicant: LG Electronics Inc., Seoul (KR)

(72) Inventors: Juhyeong Park, Seoul (KR); Minsoo Seo, Seoul (KR); Dongwon Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 122 days.

(21) Appl. No.: 16/774,103

(22) Filed: Jan. 28, 2020

(65) Prior Publication Data

US 2020/0248353 A1 Aug. 6, 2020

(30) Foreign Application Priority Data

Feb. 1, 2019 (KR) ..... 10-2019-0014085
May 7, 2019 (KR) ..... 10-2019-0053215

(51) Int. Cl.
*D06F 33/37* (2020.01)
*D06F 39/02* (2006.01)
(Continued)

(52) U.S. Cl.
CPC ..... *D06F 33/37* (2020.02); *D06F 39/02* (2013.01); *D06F 39/028* (2013.01); *D06F 39/08* (2013.01);
(Continued)

(58) Field of Classification Search
CPC ..... D06F 33/34; D06F 33/37; D06F 39/02; D06F 39/028; D06F 39/08; D06F 39/088;
(Continued)

(56) References Cited

U.S. PATENT DOCUMENTS

2007/0125134 A1 6/2007 Park
2012/0017653 A1* 1/2012 Doh ..... D06F 39/02 68/17 R
(Continued)

FOREIGN PATENT DOCUMENTS

EP 3190222 7/2017
KR 1020070002540 1/2007
(Continued)

OTHER PUBLICATIONS

Machine translation of KR 2007-0002540 A to LIM. (Year: 2007).*
(Continued)

*Primary Examiner* — Joseph L. Perrin
(74) *Attorney, Agent, or Firm* — Fish & Richardson P.C.

(57) ABSTRACT

A laundry treating apparatus includes a cabinet, a water tub, a detergent box, a main passage having a main valve and connected to the detergent box, a pre-passage having a pre-valve and connected to the detergent box, and a controller. The controller is configured to perform a method including a first main-continuous supply process of continuously supplying wash water by opening the main valve, a pre-continuous supply process of continuously supplying wash water by opening the pre-valve, and a second main-continuously supply process of continuously supplying wash water by opening the main valve. The controller controls each of the main valve and the pre-valve to supply wash water to the detergent box through the first main-continuously supply process, the pre-continuous supply process, and the second main-continuous supply process. The apparatus and method may reduce or remove a detergent residue in the detergent box.

16 Claims, 21 Drawing Sheets

(51) Int. Cl.

| | |
|---|---|
| ***D06F 39/08*** | (2006.01) |
| *D06F 105/42* | (2020.01) |
| *D06F 103/38* | (2020.01) |
| *D06F 105/06* | (2020.01) |
| *D06F 105/02* | (2020.01) |
| *D06F 33/34* | (2020.01) |
| *D06F 105/38* | (2020.01) |

(52) U.S. Cl.
CPC ..... *D06F 39/088* (2013.01); *D06F 33/34* (2020.02); *D06F 2103/38* (2020.02); *D06F 2105/02* (2020.02); *D06F 2105/06* (2020.02); *D06F 2105/38* (2020.02); *D06F 2105/42* (2020.02)

(58) Field of Classification Search
CPC ..... D06F 2103/38; D06F 2105/02; D06F 2105/06; D06F 2105/38; D06F 2105/42
See application file for complete search history.

(56) References Cited

U.S. PATENT DOCUMENTS

| | | | | |
|---|---|---|---|---|
| 2014/0157836 | A1 | 6/2014 | Zattin et al. | |
| 2017/0183807 | A1* | 6/2017 | Cinello | D06F 37/304 |
| 2017/0350060 | A1* | 12/2017 | Favaro | D06F 39/028 |

FOREIGN PATENT DOCUMENTS

| | | |
|---|---|---|
| KR | 1020080046007 | 5/2008 |
| KR | 1020120004276 | 1/2012 |

OTHER PUBLICATIONS

Extended European Search Report in European Application No. 20152444.4, dated Apr. 21, 2020, 9 pages.
Office Action in Australian Appln. No. 2020200736, dated May 24, 2021, 9 pages.

* cited by examiner

LAUNDRY TREATING APPARATUS AND WATER SUPPLY CONTROL METHOD THEREOF

CROSS-REFERENCE TO RELATED APPLICATION

Pursuant to 35 U.S.C. § 119(a), this application claims the benefit of an earlier filing date of and the right of priority to Korean Patent Application No. 10-2019-0014085, filed on Feb. 1, 2019, and Korean Patent Application No. 10-2019-0053215, filed on May 7, 2019, the contents of which are incorporated by reference herein in its entirety.

BACKGROUND

1. Technical Field

The present disclosure relates to a laundry treating apparatus and a water supply control method thereof, and one particular implementation relates to suppressing detergent residue in a detergent box.

2. Description of the Related Art

As is well known, a laundry treating apparatus is a kind of apparatus for treating (decontaminating) clothes or laundry through a washing process, a rinsing process and/or a dehydration (dewatering) process. The laundry treating apparatus is further provided with a drying function of drying the laundry which has undergone the washing process, rinsing process and/or dehydration process. The laundry includes items that can be washed, such as bedding like bedclothes, curtains, stuffed dolls, and the like.

The laundry treating apparatus includes a cabinet, a water tub provided in the cabinet, and a rotating tank (drum) rotatably provided in the water tub. The cabinet is provided with a detergent box to supply detergent to inside of the water tub. The detergent box is provided with a housing provided in the cabinet, and a drawer that can be drawn out of and pushed into the housing.

A detergent storage (accommodation) space is formed inside the drawer. The detergent storage space may include, for example, a main detergent storage portion storing a main detergent to be used during main-wash, and a pre-detergent storage portion storing pre-detergent to be used during pre-wash, and a softener storage portion storing a fabric softener.

A distribution unit for distributing wash water to each detergent storage portion of the drawer is provided above the drawer. A wash water supply passage through which wash water is introduced is connected to a rear end of the distribution unit.

The housing has a cylindrical shape opened upwardly. A front region of the housing is opened so that the drawer can be received to move back and forth. A wash water supply pipe having one end connected to the water tub is connected to a bottom of the housing. Wash water, detergent, fabric softener, etc. are supplied into the water tub through the wash water supply pipe.

By the way, in the related art laundry treating apparatus, the detergent which is dropped down into the housing together with the wash water via the detergent storage space of the drawer remains in the housing without being smoothly supplied to the water tub.

In particular, the detergent remaining in the housing of the detergent box after being in contact with the wash water is hardened and is not easily dissolved even when it is brought into contact (wetted) with the wash water. In addition, the hardened detergent disturbs the flow of wash water, which causes much more detergent to remain in the housing.

SUMMARY

Therefore, one aspect of the present disclosure is to provide a laundry treating apparatus having a detergent box, capable of preventing detergent from remaining in the detergent box, and a water supply control method thereof.

Another aspect of the present disclosure is to provide a laundry treating apparatus, capable of suppressing detergent residue due to clumped detergent, and a water supply control method thereof.

Still another aspect of the present disclosure is to provide a laundry treating apparatus, capable of suppressing detergent residue by preventing scattering of the detergent, and a water supply control method thereof.

Still another aspect of the present disclosure is to provide a laundry treating apparatus, capable of suppressing detergent residue by washing off residual detergent, and a water supply control method thereof.

Still another aspect of the present disclosure is to provide a laundry treating apparatus, capable of suppressing detergent residue caused due to wrong determination of a detergent introduction position, and a water supply control method thereof.

Still another aspect of the present disclosure is to provide a laundry treating apparatus, capable of suppressing detergent residue caused due to an increase in water level inside a detergent box by way of controlling the increase in the water level, and a water supply control method thereof.

To achieve these and other advantages and in accordance with the purpose of this specification, as embodied and broadly described herein, there is provided a laundry treating apparatus in which wash water is supplied to a detergent box through a pre-passage for a preset time while being supplied through a main passage during main-wash.

More specifically, the detergent box may be provided with a housing connected to a water tub, a drawer received in the housing and having a plurality of detergent storage spaces, and a distribution unit provided above the drawer to distribute the wash water into the plurality of detergent storage spaces. During main-wash, while the wash water is supplied through the main passage, the main passage may be closed and then pre-passage may be opened to supply the wash water. Afterwards, the main passage may be opened again to supply the wash water.

Accordingly, even if the detergent is incorrectly introduced into a wash water movement path of the pre-passage in the detergent box, the detergent can be moved into the water tub along with the wash water passed through the pre-passage, thereby suppressing detergent residue due to wrong determination of a detergent introduction position.

The plurality of detergent storage spaces inside the drawer may be provided with a main detergent storage portion for storing detergent (main detergent) to be used during the main-wash, and a pre-detergent storage portion for storing detergent (pre-detergent) to be used during the pre-wash.

The housing may be provided with a through portion connected to the water tub, a horizontal partition protruding above the through portion inside the housing and extending in left and right directions, and a wash water guide unit to guide the wash water so that a plurality of wash water movement paths is defined at a front region of the horizontal partition.

Accordingly, during the main-wash, detergent, which remains at the front of the horizontal partition as wash water passed through the main passage and the main detergent storage portion is moved to the front of the horizontal partition over the horizontal partition, can be washed out by the wash water which is moved along the plurality of wash water movement paths by the wash water guide unit via the pre-passage and the pre-detergent storage portion, thereby suppressing the detergent residue at the inner front region of the housing.

The wash water guide unit may include a vertical partition protruding at one side of the horizontal partition and disposed in the back and forth directions of the housing, and an extension partition formed at the front of the vertical partition with being spaced apart from the vertical partition.

With this configuration, a part of the wash water dropped into the rear region of the housing can be moved between the vertical partition and the extension partition, and another part can be moved to a front region of the extension partition, so that at least two wash water movement paths can be formed at the front region of the horizontal partition. Accordingly, detergent remaining at the front region of the horizontal partition can be washed out, thereby suppressing the detergent residue at the front region of the horizontal partition in the housing.

The extension partition may include a first extension partition disposed at one side of the vertical partition, and a second extension partition disposed at one side of the first extension partition.

With this configuration, a part of the wash water moved along the vertical partition can be moved between the vertical partition and the first extension partition, another part can be moved between the first extension partition and the second extension partition, and still another part can be moved to the front region of the second extension partition to flow toward the through portion, so that at least three wash water movement paths can be defined at the front region of the horizontal partition. Accordingly, the detergent residue at the front region of the horizontal partition can be remarkably suppressed.

More specifically, the laundry treating apparatus may include a cabinet, a water tub provided inside the cabinet, a detergent box connected to the water tub to supply detergent to the water tub, a main passage connected to the detergent box to supply wash water, a main valve provided at the main passage, a pre-passage connected to the detergent box to supply wash water, a pre-valve provided at the pre-passage, and a controller configured to perform a first main-continuous supply process of continuously supplying the wash water by opening the main valve for a preset time, a pre-continuous supply process of continuously supplying the wash water by opening the pre-valve for a preset time, and a second main-continuous supply process of continuously supplying the wash water by opening the main valve, and control each of the main valve and the pre-valve to supply the wash water to the detergent box through the first main-continuously supply process, the pre-continuous supply process, and the second main-continuous supply process. With the configuration, detergent residue in the detergent box can be suppressed.

Here, an opening time of the main valve during the first main-continuous supply process may be set to a first preset time or shorter.

The first preset time may be set in consideration of a degree that a water level inside the drawer rises as a speed of supplying the wash water becomes faster than a speed of discharging the wash water from the drawer due to relative high pressure during the supply of the wash water into the drawer.

The first preset time may preferably be set to 10 seconds or shorter.

Accordingly, when the detergent having a specific gravity smaller than that of the wash water is introduced into the drawer, it is possible to prevent the detergent from remaining in the detergent box as the detergent floats on a surface of the wash water and is stuck on inner walls or ceiling of the detergent box.

The controller may perform a main-intermittent supply process of intermittently opening and closing the main valve to intermittently supply the wash water of the main passage to the detergent box before the first main-continuous supply process.

Here, opening and closing the main valve intermittently means repeating an operation of opening and closing the main valve a predetermined number of times at a relatively short time interval.

Accordingly, clumped detergent in the detergent (washing powder) supplied to the inside of the detergent box can be split into small grains or an original powder form, so as to be easily moved along with the wash water, thereby suppressing the detergent residue in the detergent box.

In addition, the detergent residue, which results from that the detergent inside the detergent box is scattered by the wash water sprayed at high pressure during the continuous opening of the main valve, can be prevented.

More specifically, when the wash water inside the detergent box is continuously supplied, the detergent inside the drawer may be scattered and/or floated by the wash water sprayed at high pressure, and stuck on regions, which the wash water is relatively difficult to reach, thereby remaining in the detergent box. However, when the wash water is supplied intermittently, a relatively small amount of wash water can first be in contact with the detergent and wet the detergent. Through repetition of this process a preset number of times, scattering and/or floating of the detergent during the supply of the wash water can be prevented, and the detergent can be stably moved into the housing along with the wash water. Therefore, the detergent residue in the detergent box can be suppressed.

The controller can control the main valve so that a process of opening the main valve for a main-intermittent opening time and closing the main valve for a main-intermittent closing time is repeated by a preset main-intermittent opening and closing frequency, during the main-intermittent supply process.

The main-intermittent opening time may be set in a range of 0.15 to 0.25 seconds, and may preferably be 0.2 seconds.

The main-intermittent closing time may be set in a range of 3.6 to 6 seconds, and may preferably be 4.8 seconds.

In detail, preferably, the main-intermittent opening time may be 0.2 seconds, the main-intermittent closing time may be 4.8 seconds, and the main-intermittent opening and closing frequency may be six times.

With this configuration, when the wash water of the main passage is supplied, clumped detergent in the main detergent can be split into sufficiently small grains by the intermittently supplied wash water, thereby suppressing the detergent residue in the detergent box due to the clumped detergent.

In addition, the detergent residue in the detergent box due to scattering and/or floating of the detergent when supplying the wash water of the main passage can be suppressed.

The controller may perform a pre-intermittent supply process of intermittently opening and closing the pre-valve to intermittently supply the wash water of the pre-passage to the detergent box, before the main-intermittent supply process.

The controller may control the pre-valve so that a process of opening the pre-valve for a pre-intermittent opening time and closing the pre-valve for a pre-intermittent closing time is repeated by a preset pre-intermittent opening and closing frequency, during the pre-intermittent supply process.

Here, the pre-intermittent opening time may be set in a range of 0.25 to 0.35 seconds, and may preferably be 0.3 seconds.

The pre-intermittent closing time may be set in a range of 3.92 to 5.48 seconds, and may preferably be 4.7 seconds.

With this configuration, when the wash water in the pre-passage is supplied, clumped detergent in the pre-detergent can be split into sufficiently small grains by the intermittently supplied wash water so as to be easily moved along with the wash water, thereby suppressing the detergent residue in the detergent box due to the clumped detergent.

In addition, the detergent residue in the detergent box due to scattering and/or floating of the detergent when supplying the wash water of the pre-passage can be suppressed.

On the other hand, an opening time of the pre-valve in the pre-continuous supply process may be set to correspond to a time for which the wash water passed through the drawer reaches the through portion by the guide of the wash water guide unit.

With this configuration, in the first main-continuous supply process, even if a water level in the housing is abnormally raised so that the detergent remains at the front region of the horizontal partition, it can be washed out by the wash water which has passed through the pre-passage and moved along the plurality of wash water movement paths formed at the front region of the horizontal partition by the wash water guide unit.

On the other hand, a water supply control method of a laundry treating apparatus according to another aspect of the present disclosure may be configured to close a main passage after continuously supplying wash water by opening the main passage, of the main passage and a pre-passage connected to a detergent box, close the pre-passage after continuously supplying the wash water by opening the pre-passage, and then continuously supply the wash water to the detergent box by re-opening the main passage.

More specifically, according to one embodiment of the present disclosure, a water supply control method of a laundry treating apparatus, which includes a cabinet, a water tub provided inside the cabinet, a detergent box connected to the water tub to supply detergent to the water tub, a main passage connected to the detergent box to supply wash water during main-wash, a main valve provided at the main passage, a pre-passage connected to the detergent box to supply the wash water during pre-wash, and a pre-valve provided at the pre-passage, the method including performing a first main-continuous supply process of continuously supplying the wash water by opening the main valve for a preset time, performing a pre-continuous supply process of continuously supplying the wash water by opening the pre-valve for a preset time, and performing a second main-continuous supply process of continuously supplying the wash water by opening the main valve for a preset time.

The method may further include a main-intermittent supply process of intermittently supplying the wash water of the main passage to the detergent box by intermittently opening and closing the main valve before the first main-continuous supply process.

With this configuration, clumped detergent in a main detergent in the detergent box can be split into relatively small grains to be easily moved along with the wash water and a relatively small amount of wash water can be intermittently supplied to the detergent so as to prevent scattering and/or floating of the detergent, thereby suppressing the detergent residue in the detergent box.

The main-intermittent supply process may be configured to repeat a process of opening the main valve for a main-intermittent opening time and closing the main valve for a main-intermittent closing time by a preset main-intermittent opening and closing frequency.

The method may further include a pre-intermittent supply process of intermittently supplying the wash water of the pre-passage to the detergent box by intermittently opening and closing the pre-valve before the main-intermittent supply process.

With this configuration, clumped detergent in a pre-detergent in the detergent box can be split into relatively small grains to be easily moved along with the wash water and a relatively small amount of wash water can be intermittently supplied to the detergent so as to prevent scattering and/or floating of the detergent, thereby suppressing the detergent residue in the detergent box.

The pre-intermittent supply process may be configured to repeat a process of opening the pre-valve for a pre-intermittent opening time and closing the pre-valve for a pre-intermittent closing time by a preset pre-intermittent opening and closing frequency.

The main-intermittent opening time may be shorter than the main-intermittent closing time.

The pre-intermittent opening time may be shorter than the pre-intermittent closing time.

The main-intermittent opening time may be shorter than the pre-intermittent opening time.

Accordingly, a relatively small amount of wash water can be intermittently supplied to the main detergent storage portion storing a relatively large amount of detergent, thereby lowering the possibility of scattering and/or floating of the main detergent.

The pre-intermittent opening and closing frequency may be greater than the main-intermittent opening and closing frequency.

A preset waiting time may be provided between the first main-continuous supply process and the pre-continuous supply process and between the pre-continuous supply process and the second main-continuous supply process.

Here, the waiting time may be set in consideration of a time for which the wash water passed through the main passage or the pre-passage can reach the through portion via the drawer.

As described above, according to one embodiment of the present disclosure, detergent residue in the detergent box can be suppressed by configuring the controller which controls the main valve and the pre-valve so that the wash water can be supplied to the detergent box through the first main-continuous supply process, the pre-continuous supply process and the second main-continuous supply process.

In addition, the controller can facilitate movement of the detergent by splitting clumped detergent into small grains, through the main-intermittent supply process of intermittently supplying the wash water of the main passage to the detergent box by intermittently opening and closing the main valve, thereby suppressing the detergent residue in the detergent box.

Also, the controller can facilitate movement of the detergent by splitting clumped detergent into small grains through the pre-intermittent supply process of intermittently supplying the wash water of the pre-passage to the detergent box by intermittently opening and closing the pre-valve before the main-intermittent supply process.

In addition, with the configuration that the through portion is formed through the bottom of the housing of the detergent box, the horizontal partition is formed above the through portion, and the wash water guide unit is formed at one side of the horizontal partition for guiding the wash water to flow along the plurality of wash water movement paths defined at the front region of the horizontal partition, the detergent remaining at the front region of the horizontal partition can be removed by the wash water flowing along the plurality of wash water movement paths, thereby suppressing the detergent residue in the detergent box.

DETAILED DESCRIPTION OF THE EMBODIMENTS

Hereinafter, embodiments disclosed in this specification will be described in detail with reference to the accompanying drawings. In this specification, the same or equivalent components may be provided with the same or similar reference numbers even in different embodiments, and description thereof will not be repeated. A singular representation may include a plural representation unless it represents a definitely different meaning from the context. In describing the present disclosure, if a detailed explanation for a related known technology or construction is considered to unnecessarily divert the gist of the present disclosure, such explanation has been omitted but would be understood by those skilled in the art. It should be noted that the attached drawings are provided to facilitate understanding of the embodiments disclosed in this specification, and should not be construed as limiting the technical idea disclosed in this specification by the attached drawings.

Figure 1:
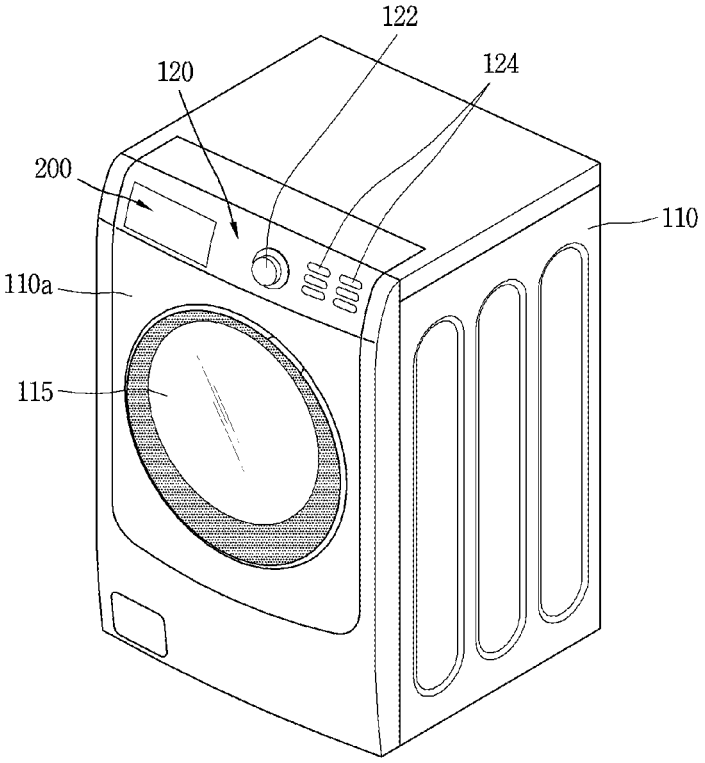
FIG. 1 is a perspective view of a laundry treating apparatus in accordance with one embodiment.
Figure 2:
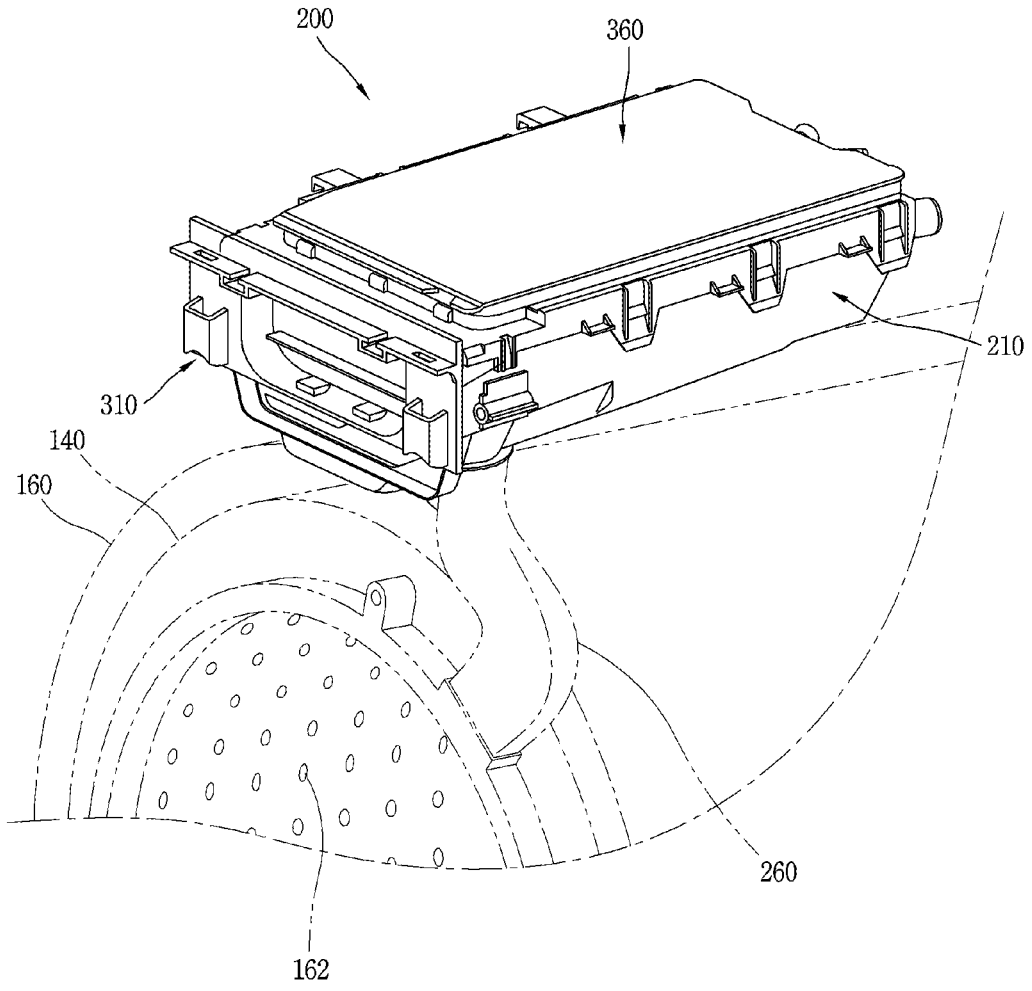
FIG. 2 is a perspective view of a detergent box of FIG. 1.

FIG. 1 is a perspective view of a laundry treating apparatus in accordance with one embodiment, and FIG. 2 is a perspective view of a detergent box of FIG. 1. As illustrated in FIGS. 1 and 2, a laundry treating apparatus according to one embodiment disclosed herein may include a cabinet 110, a water tub 140 and a detergent box 200.

The cabinet 110 defines appearance of the laundry treating apparatus. The cabinet 110 may have a substantially rectangular parallelepiped shape. The water tub 140 is provided inside the cabinet 110. The water tub 140 defines an accommodation space of wash water therein. The water tub 140 has a cylindrical shape with a front opening. A drum 160 is provided inside the water tub 140. The drum 160 has a cylindrical shape with a front opening. The drum 160 is provided with a plurality of through holes 162 on a circumferential surface thereof. The inside of the drum 160 communicates with an inside of the water tub 140 through the front opening of the drum 160 and the plurality of through holes 162. The drum 160 rotates centering on a rotational shaft (not illustrated) provided at its rear end. A drum driving motor (not illustrated) for rotating the drum 160 is provided at the rear end of the water tub 140.

The cabinet 110 is provided with a front opening. The front opening of the cabinet 110 communicates with the opening of the water tub 140 and the opening of the drum 160. Accordingly, the clothes (the laundry) can be introduced into the drum 160. A door 115 for opening and closing the opening is provided on the front surface of the cabinet 110. The door 115, for example, rotates up and down centering on a rotational shaft (not illustrated) disposed at the cabinet 110. The cabinet 110 is provided with a control panel 120 to select an operation mode.

The control panel 120 may be provided on a front surface of the cabinet 110. The control panel 120 includes a dial 122 and a plurality of control buttons 124 for selecting and inputting signals. The cabinet 110 is provided with a detergent box 200 for supplying detergent into the water tub 140.

The detergent box 200, for example, is provided with a housing 210, a drawer 310, and a distribution unit 360. The housing 210 is provided in the cabinet 110. The distribution unit 360 is provided at an upper side of the housing 210. The drawer 310 is accommodated inside the housing 210 to be drawn out. The distribution unit 360 is disposed at an upper end of the housing 210 to be spaced apart from a bottom of the housing 210. The drawer 310 is inserted into and drawn out of a lower space of the distribution unit 360 inside the housing 210.

Figure 3:
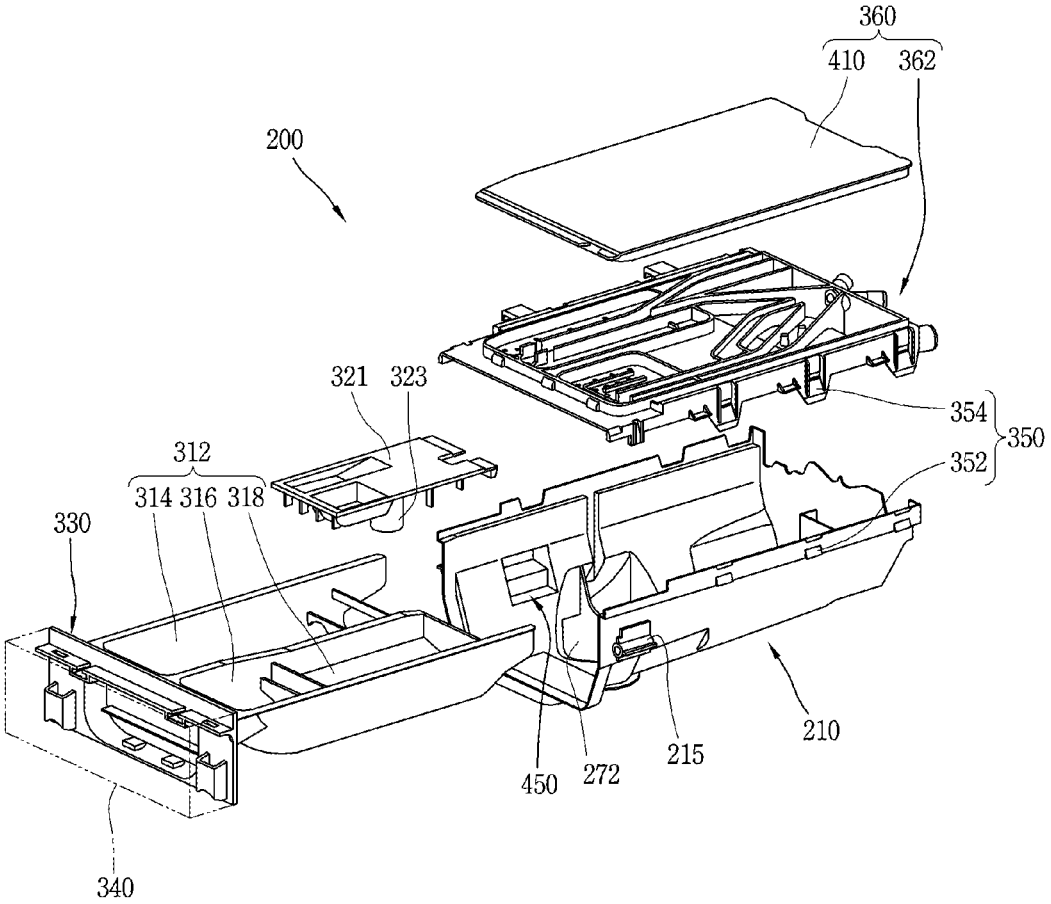
FIG. 3 is an exploded perspective view of the detergent box of FIG. 2.

FIG. 3 is an exploded perspective view of the detergent box 200 of FIG. 2. As illustrated in FIG. 3, the housing 210 is implemented to define an inner accommodation space having a substantially rectangular parallelepiped shape. The housing 210 is open at its upper and front sides, for example. The distribution unit 360 is disposed at the upper side of the housing 210. The distribution unit 360 is coupled to block the upper opening of the housing 210. The distribution unit 360 is engaged with the housing 210 in an up and down direction.

An engagement coupling portion 350 is provided on a mutual contact area between the housing 210 and the distribution unit 360. The engagement coupling portion 350, for example, is provided with stopping jaws 352 formed on any one of the housing 210 and the distribution unit 360, and stopping jaw accommodating portions 354 formed on the other for accommodating the stopping jaw 352. The stopping jaws 352 may be provided on the housing 210. The stopping jaw accommodating portions 354 may be provided on the distribution unit 360.

The distribution unit 360 may include a distribution unit body 362 having a plurality of wash water movement paths 390 therein, and an upper cover 410 coupled to block an upper side of the distribution unit body 362. The distribution unit body 362 is provided therein with wash water movement paths 390 that are upwardly opened. The upper cover 410 is implemented in a rectangular plate shape of a size corresponding to the distribution unit body 362. The upper cover 410, for example, may be disposed on a top of the distribution unit body 362 and integrally coupled to the distribution unit body 362 by fusion.

The drawer 310 may be accommodated in the housing 210 to be pulled out through the front opening of the housing 210. The drawer 310 is provided with a plurality of detergent storage spaces 312 therein. The plurality of detergent storage spaces 312 may include, for example, a main detergent storage portion 314 in which a main detergent to be used during main-wash is stored (accommodated). The plurality of detergent storage spaces 312 includes a pre-detergent storage portion 316 in which a pre-detergent to be used during pre-wash is stored. Here, the main detergent and the pre-detergent may be the same detergent or different detergents. The plurality of detergent storage spaces 312 also includes a fabric softener storage portion 318 in which a liquid detergent or a fabric softener (hereinafter, referred to as "fabric softener") is stored. A siphon generating member 321 for allowing the fabric softener to be supplied downward by a siphon phenomenon is coupled to the fabric softener storage portion 318. A front blocking portion 330 for blocking the front opening of the housing 210 when the drawer 310 is accommodated in the housing 210 is provided at a front region of the drawer 310. The front blocking portion 330 is provided with a front cover 340 coupled to the front thereof.

Figure 4:
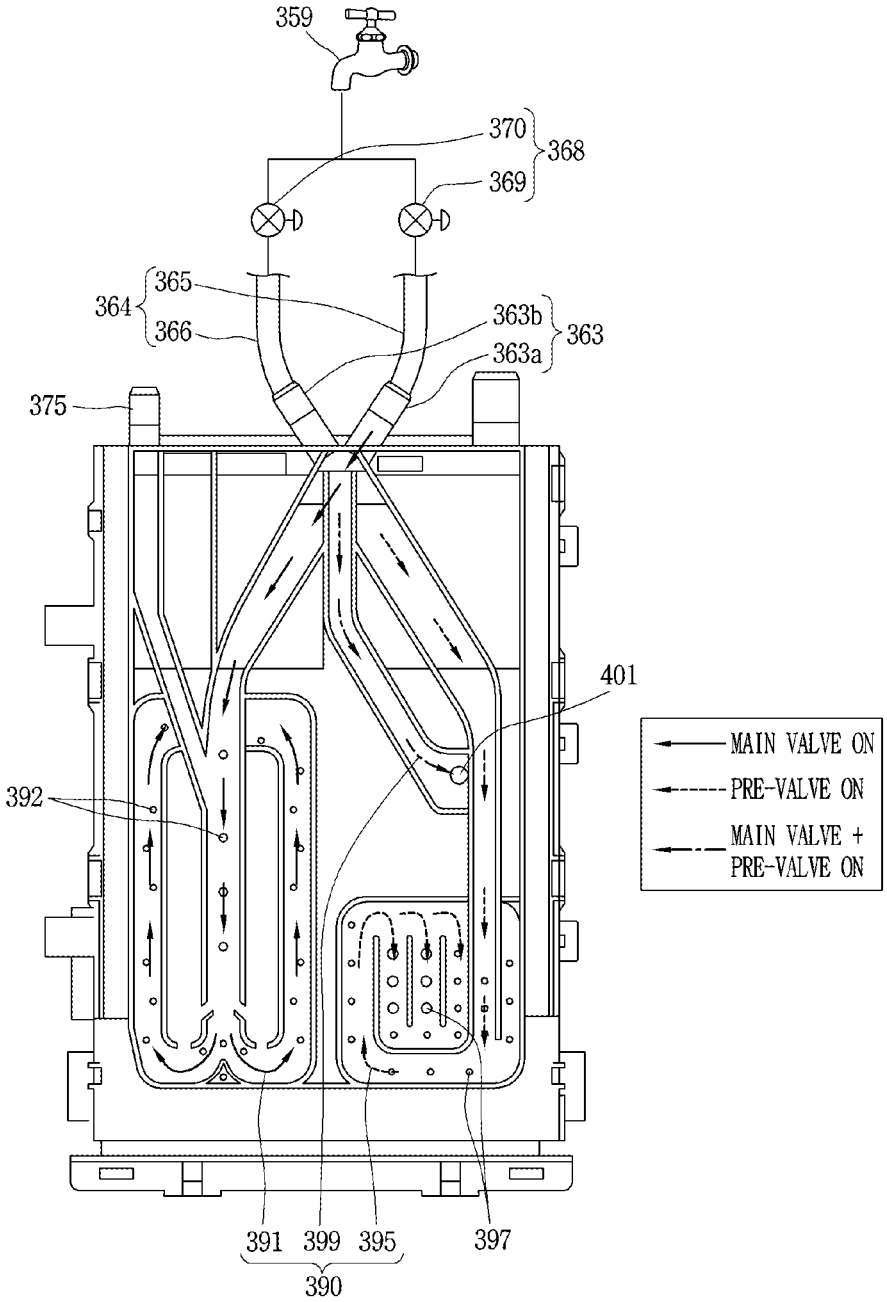
FIG. 4 is a planar view of a distribution unit body of FIG. 3.

FIG. 4 is a planar view of the distribution unit body 362 of FIG. 3. As illustrated in FIG. 4, the plurality of wash water movement paths 390 are provided in the distribution unit body 362. A wash water supply passage 364 is connected to a rear end of the distribution unit body 362. The wash water supply passage 364 includes a main-wash water supply passage or main passage 365 (hereinafter, referred to as a "main passage 365") for supplying wash water during main-wash. The wash water supply passage 364 includes a pre-wash water supply passage or pre-passage 366 (hereinafter, referred to as a "pre-passage 366") for supplying wash water during pre-wash. Here, the pre-wash refers to a process of rotating or stopping the drum 160 at a preset speed for a preset time in order to perform a role of keeping contaminated laundry soaked in water in advance or removing contamination of the laundry. The main-wash refers to a process of removing the contamination from the laundry in earnest by using a chemical action of the detergent and a physical action of the drum 160, namely, typically refers to a process of rotating the drum 160 forward or backward for a preset time at a faster rotational speed than that in the pre-wash.

The main passage 365 is provided with a main valve 369 to open and close the passage. The pre-passage 366 is provided with a pre-valve 370 to open and close the passage. The main passage 365 and the pre-passage 366 are connected to a faucet 359 of a water supply. The faucet 359 of the water supply is typically kept open, and the main valve 369 and the pre-valve 370 are typically kept closed.

The distribution unit body 362 is provided with a main passage connecting portion 363*a* to which the main passage 365 is connected. The distribution unit body 362 is provided with a pre-passage connecting portion 363*b* to which the pre-passage 366 is connected. The main passage connecting portion 363*a* and the pre-passage connecting portion 363*b* protrude rearward to be inclined in different directions. For example, the main passage connecting portion 363*a* is disposed to be inclined to a rear right side of the distribution unit body 362 in the drawing, and the pre-passage connecting portion 363*b* is disposed to be inclined to a rear left side of the distribution unit body 362 in the drawing.

The plurality of wash water movement paths 390 include a main valve supply portion 391 through which wash water is supplied when the main valve 369 is opened. The main valve supply portion 391 is connected to the main passage connecting portion 363*a*. The main valve supply portion 391 is mainly formed in a left region of the distribution unit body 362 in the drawing, for example. The main valve supply portion 391 is provided with a plurality of distribution holes 392 formed through a bottom surface thereof. A hot water supply portion 375 for supplying hot water may be connected to one side of the main valve supply portion 391, for example.

The plurality of wash water movement paths 390 include a pre-valve supply portion 395 through which wash water is supplied when the pre-valve 370 is opened. The pre-valve supply portion 395 is connected to the pre-passage connecting portion 363*b*. The pre-valve supply portion 395 is formed in a right front region of the distribution unit body 362 in the drawing. The pre-valve supply portion 395 is provided with a plurality of distribution holes 397 formed through a bottom surface thereof.

On the other hand, a main-pre valve supply portion 399 for supplying wash water when the main valve 369 and the pre-vale 370 are simultaneously opened is provided between the main valve supply portion 391 and the pre-valve supply portion 395. A distribution hole 401 is formed through a bottom surface of the main-pre valve supply portion 399. The distribution hole 401 is formed at a position where wash water may fall down into the fabric softener storage portion 318.

Figure 5:
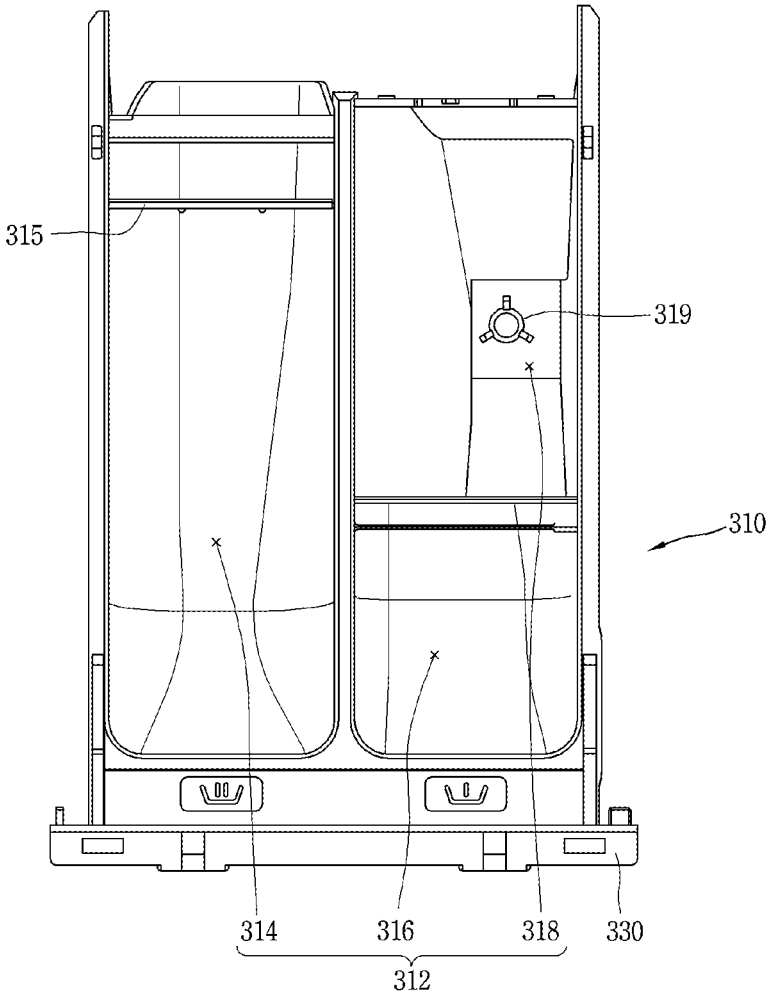
FIG. 5 is a planar view of a drawer of FIG. 3.

FIG. 5 is a planar view of the drawer 310 of FIG. 3. As illustrated in FIG. 5, the plurality of detergent storage spaces 312 is formed in the drawer 310. The plurality of detergent storage spaces 312 includes the main detergent storage portion 314 in which detergent to be used during main-wash is stored (accommodated). The plurality of detergent storage spaces 312 includes a pre-detergent storage portion 316 in which detergent to be used during pre-wash is stored. The plurality of detergent storage spaces 312 includes a fabric softener storage portion 318 in which fabric softener to be used during a rinsing stroke is stored.

The main detergent storage portion 314 is formed at, for example, a left region inside the drawer 310. The pre-detergent storage portion 316 is formed at a right front region inside the drawer 310. The fabric softener storage portion 318 is formed at a right rear region inside the drawer 310.

The main detergent storage portion 314 may be inclined rearward so that wash water passed through the main valve supply portion 391 can be moved backward with detergent. A barrier 315 is provided at a rear region of the main detergent storage portion 314. The barrier 315 applies resistance to detergent stored in the main detergent storage portion 314 so that the detergent can move backward slowly, not at a time. A through portion 315*a* may be formed through the barrier 315 to allow an appropriate amount of detergent and wash water to pass therethrough. For example, the through portion 315*a* may be formed such that a center of the barrier 315 is blocked and both side regions or one side region of the barrier 315 are (is) penetrated.

The pre-detergent storage portion 316 may be inclined rearward so that wash water passed through the pre-valve supply portion 395 can be moved backward with detergent.

The fabric softener storage portion 318 is located at the rear of the pre-detergent storage portion 316. The fabric softener storage portion 318 is provided with an outlet tube 319 to allow the fabric softener to flow downward out of the fabric detergent storage space 318. The outlet tube 319 protrudes upward from a bottom surface of the fabric softener storage portion 318. The outlet tube 319 is coupled to a tubular portion 323 of the siphon generating member 321. The outlet tube 391 is accommodated in the tubular portion 323, so that a movement path for fabric softener is formed between an inner surface of the tubular portion 323 and an outer surface of the outlet tube 319. The tubular portion 323 is spaced apart from the bottom of the fabric softener storage portion 318 by a preset distance so that the fabric softener can be introduced. When a water level of fabric softener in the fabric softener storage portion 318 rises above a height of the outlet tube 319, the fabric softener starts to flow out. When the fabric softener starts to flow out, even if the water level of the fabric softener is lower than the height of the outlet tube 319 due to the siphon phenomenon, the fabric softener can continue to flow out.

Figure 6:
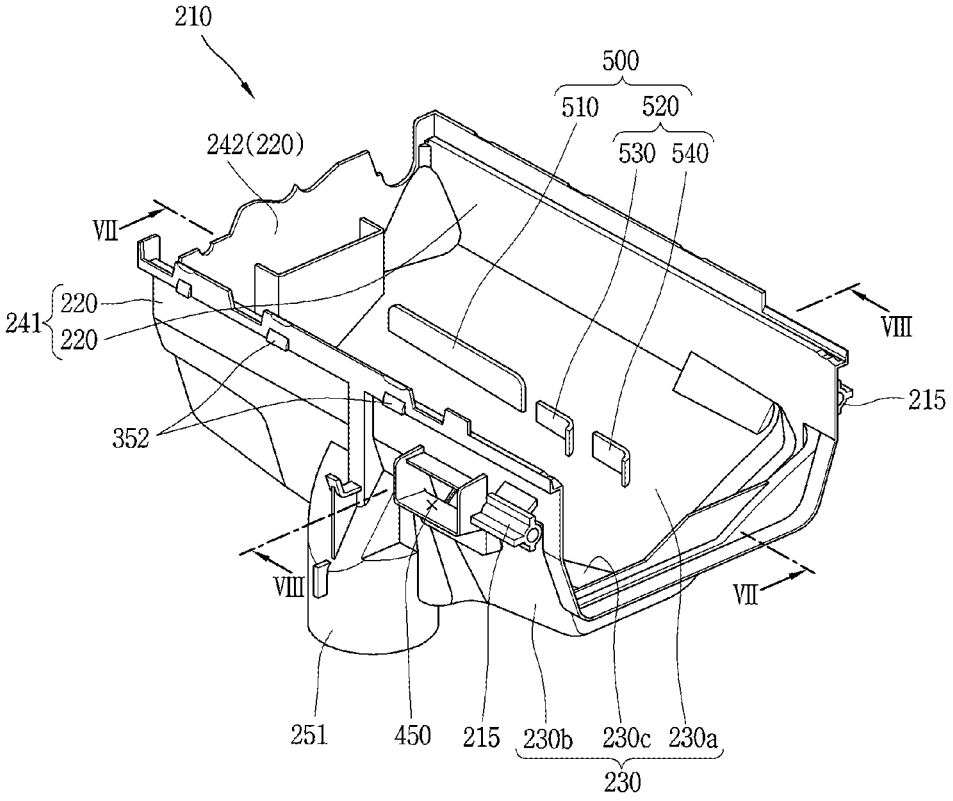
FIG. 6 is a perspective of a housing of FIG. 3.
Figure 7:
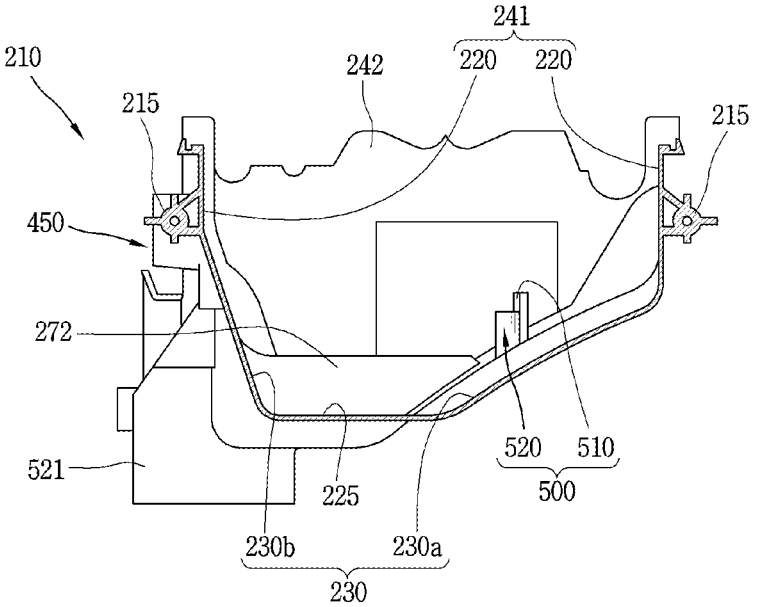
FIG. 7 is a cross-sectional view taken along the line VIII-VIII of FIG. 6.
Figure 8:
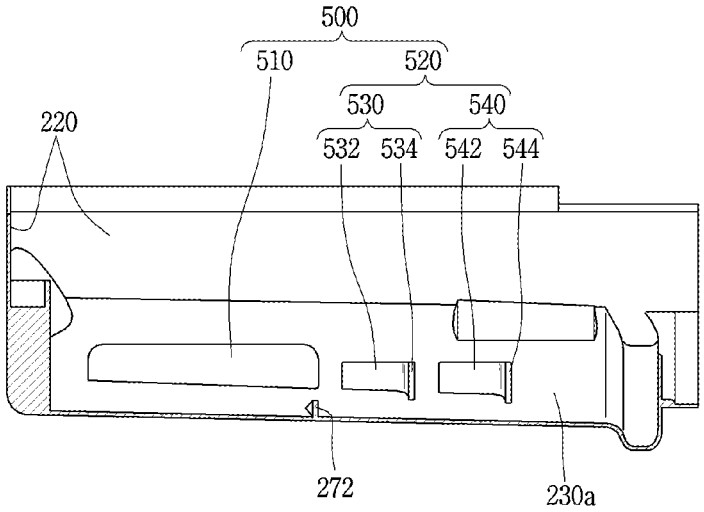
FIG. 8 is a cross-sectional view taken along the line VII-VII of FIG. 6.

FIG. 6 is a perspective of a housing of FIG. 3, FIG. 7 is a cross-sectional view taken along the line VII-VII of FIG. 6, and FIG. 8 is a cross-sectional view taken along the line VIII-VIII of FIG. 6. As illustrated in FIGS. 6 and 7, the housing 210 has a shape with upper and lower openings. The housing 210 is disposed at an inner side of a front plate 110*a* of the cabinet 110. Screw coupling portions 215 to be coupled with screws are formed on front regions of outer surfaces of both side portions 241 of the housing 210.

The housing 210 includes a plurality of vertical (longitudinal) sections 220 for accommodating the drawer 310, a horizontal section 225 formed below the drawer 310, and a plurality of inclined sections 230. The plurality of vertical sections 220 is disposed at both sides and the rear side of the drawer 310, respectively. The horizontal section 225 and the plurality of inclined sections 230 are formed at the lower side of the drawer 310, respectively.

The housing 210 includes both side portions 241 disposed at both sides of the drawer 310, a rear portion 242 disposed at the rear of the drawer 310, and a bottom surface disposed below the drawer 310.

The both side portions 241 include the vertical sections 220 disposed at the both sides of the drawer 310, respectively.

The rear portion 242 includes the vertical section 220 disposed at the rear side of the drawer 310.

The bottom portion 245 includes the horizontal section 225 and the plurality of inclined sections 230.

The bottom portion 245 has a through portion 247 formed therethrough to allow wash water to flow out. The through portion 247 may be formed through the horizontal section 225. Here, the horizontal section 225 may also be slightly inclined toward the through portion 247 (for example, having a small inclination relative to the inclined section 230). The plurality of inclined sections 230 may be inclined toward the through portion 247. As a result, wash water inside the housing 210 may be smoothly moved toward the through portion 247. If a movement (speed) of wash water along the plurality of inclined sections 230 is too slow due to small inclinations of the plurality of inclined sections 230, transfer performance of detergent is lowered. On the other hand, if the movement of the wash water is too fast due to large inclinations of the plurality of inclined sections 230, a distance by which the wash water moves over the through portion 247 increases. Therefore, those cases are not preferable. The plurality of inclined sections 230 may be configured to have preset inclinations, respectively, in consideration of those cases.

The through portion 247 may be formed at one side (left side in the drawing) of the horizontal section 225. The through portion 247 may alternatively protrude to outside of the housing 210. A wash water supply tube 260 may be provided such that one end portion thereof is connected to the water tub 140 and another end portion is connected to the through portion 247 (see FIG. 2). Accordingly, the inside of the water tub 140 and the inside of the housing 210 may communicate with each other. The through portion 247 may be provided with a wash water supply tube connecting portion 251 to which the wash water supply tube 260 is connected.

A ventilation portion 450 is formed through one side surface (left surface in the drawing, for example) of the housing 210 so that the inside and outside of the housing 210 can communicate with each other. As a result, the inside of the water tub 140 communicates with the outside of the housing 210. With this configuration, when the door 115 is closed after a baby or an animal has entered the drum 160 through the front opening of the cabinet 110, the baby or the animal inside the drum 160 can breathe through the wash water supply tube 260 and the ventilation portion 450.

The plurality of inclined sections 230 may include a first inclined section (right inclined section) 230*a* and a second inclined section (left inclined section) 230*b* which are downwardly inclined from the both side portions 241 of the housing 210 to the inside of the housing 210, a third inclined section (front inclined section) 230*c* disposed at the front of the through portion 247, and a fourth inclined section (rear inclined section) 230*d* disposed at the rear of the through portion 247.

Here, the first inclined section 230*a* and the second inclined section 230*b* may be configured to have different inclination angles (inclinations) with respect to the horizontal section 225. The first inclined section 230*a* and the second inclined section 230*b* are inclined inwards along left and right directions of the housing 210, respectively. The second inclined section 230*b* may have a larger inclination angle than the first inclined section 230*a* and may be relatively nearly-longitudinal. The first inclined section 230*a* is a section in which a wash water movement path is formed, and has a relatively low (small) inclination. The third inclined section 230*c* and the fourth inclined section 230*d* are inclined along the back and forth directions of the housing 210, respectively. The third inclined section 230*c* is downwardly inclined toward the through portion 247 located at its rear side. The fourth inclined section 230*d* is downwardly inclined toward the through portion 247 located at its front side.

On the other hand, the bottom portion 245 of the housing 210 is configured such that wash water falling down to the inner rear region of the housing 210 together with detergent can be smoothly moved toward the through portion 247 so as to be supplied into the water tub 140. The bottom portion 245 of the housing 210 is provided with the plurality of inclined sections 230 so that wash water can have an appropriate moving speed.

The bottom portion 245 of the housing 210 is provided with a horizontal partition 272 protruding above the through portion 247 and disposed in the left and right directions of the housing 210. Accordingly, wash water dropped to the inner rear region of the housing 210 can be suppressed from excessively moving to an inner front region of the housing 210 over the through portion 247 of the housing 210. When the wash water moved together with the detergent is excessively moved forward of the housing 210, the detergent moved forward is more highly likely to remain at the inner front region of the housing 210. More specifically, since the detergent moved to the inner front region of the housing 210 is relatively difficult to be removed, the possibility that the detergent remaining thereat increases. For example, when only the horizontal partition 272 is provided inside the housing 210, wash water and part of detergent which have moved forward of the horizontal partition 272 due to overflow caused by an increase in water level in the housing 210 are discharged through the through portion 247 but other part of the detergent moved to the inner front region of the housing 210 together with the wash water mostly remains at the inner front region of the housing 210. In order to remove the detergent, it is needed to form a movement path of wash water to a front region of the horizontal partition 272.

The horizontal partition 272 is located lower than the ventilation portion 450. Accordingly, when a level of wash water in the housing 210 rises, the wash water can move to the front region of the horizontal partition 272 over the horizontal partition 272 without being discharged to outside of the housing 210 through the ventilation portion 450, thereby preventing an excessive increase in the water level of housing 210.

The horizontal partition 272 is formed at a point moved forward by a preset distance from a center of the through portion 247 in the back and forth direction of the housing 210. An amount of wash water and detergent introduced into the through portion 247 may be controlled by the horizontal partition 272. More specifically, the horizontal partition 272 may be formed at a point where it divides an inner space of the through portion 247 at a preset ratio (for example, about 70:30). Accordingly, wash water dropped via the main detergent storage portion 314 is mostly supplied to the water tub 140 by the horizontal partition 272 through the rear region of the inner space of the through portion 247. When pressure of wash water passed through the main detergent storage portion 314 is abnormally (unusually) increased and thereby a flow rate is excessively increased to raise a water level, the detergent and wash water may be moved to the front region of the horizontal partition 272 over the horizontal partition 272. The detergent and wash water moved to the front region of the horizontal partition 272 may be supplied to the water tub 140 through the inner front region of the through portion 247 located at the front of the horizontal partition 272.

The horizontal partition 272 includes a first section disposed above the through portion 247, and a second section 272*b* extending from the first section 272*a* so as to be located in the second inclined section 230*b*. The first section 272*a* is disposed in the left and right directions of the housing 210. The second section 272*b* is disposed to be inclined rearward in the left and right directions of the housing 210. The second section 272*b* may have an inclination angle of about 30 to 40 degrees with respect to the housing 210 (see FIG. 11).

The housing 210 is provided with a wash water guide unit 500 for guiding wash water such that a plurality of wash water movement paths is formed at the front region of the horizontal partition 272. Accordingly, detergent remaining at the front region of the horizontal partition 272 is washed out by the wash water flowing along the wash water movement paths formed at the front region of the horizontal partition 272, thereby suppressing detergent residue on the inner front region of the housing 210.

The wash water guide unit 500 may include a vertical partition 510 protruding at one side of the horizontal partition 272 and disposed in the back and forth direction of the housing 210, and an extension partition 520 formed at the front of the vertical partition 510 with being spaced apart from the vertical partition 510.

The vertical partition 510 protrudes upward in the first inclined section 230*a*. The vertical partition 510 has a substantially rectangular plate shape. The vertical partition 510 is spaced forwardly apart from the rear portion 242 of the housing 210 by a preset distance. Accordingly, a part of wash water dropped via the pre-detergent storage portion 316 may be moved to the rear region of the horizontal partition 272 between the rear portion 242 and a rear end portion of the vertical partition 510.

The extension partition 520 has a substantially rectangular plate shape. The extension partition 520 is formed at the front of the vertical partition 510 with being spaced a preset distance apart from the vertical partition 510. As a result, another part of the wash water dropped via the pre-detergent storage portion 316 is moved downward between the vertical partition 510 and the extension partition 520. In addition, still another part of the wash water dropped via the pre-detergent storage portion 316 is moved forward of the extension partition 520 so as to be moved downward. As a result, the wash water dropped via the pre-detergent storage portion 316 is moved to the front region of the horizontal partition 272 along the two movement paths.

The wash water dropped via the pre-detergent storage portion 316 is partially moved along the vertical partition 510, partially moved downward between the vertical partition 510 and the extension partition 520 to form a first movement path toward the horizontal partition 272, and also partially moved downward after moved forward of the housing 210 along the extension partition 520 so as to form a second movement path toward the horizontal partition 272 via the front region of the housing 210. As a result, the detergent remaining at the front region of the horizontal partition 272 can be effectively washed out, and thus the detergent residue on the inner front region of the housing 210 can be suppressed.

The extension partition 520 includes a first extension partition 530 formed at one side of the vertical partition 510 and a second extension partition disposed at the front the first extension partition 530 in a spaced manner. As a result, the wash water dropped via the pre-detergent storage portion 316 forms the plurality of wash water movement paths at the front of the horizontal partition 272. This may result in suppressing the detergent residue at the front region of the horizontal partition 272.

More specifically, the first extension partition 530 includes a first extension partition body 532 and a first bent end portion 534 bent from the first extension partition body 532. The first extension partition body 532 is disposed along the back and forth direction of the housing 210. The first bent end portion 534 is bent from a front end of the first extension partition body 532. Wash water moved along the first extension partition body 532 may be guided by the first bent end portion 534 to be stably moved downward.

The second extension partition 540 includes a second extension partition body 542 and a second bent end portion 544 bent from the second extension partition body 542. The second extension partition body 542 is disposed along the back and forth direction of the housing 210. The second bent end portion 544 is bent from a front end of the second extension partition body 542. Wash water moved along the second extension partition body 542 may be guided by the second bent end portion 544 to be stably moved downward.

Here, the extension partition 520 may be configured to have a relatively lower height than the vertical partition 510. This is because some of the wash water dropped via the pre-detergent storage portion 316 have already been moved along both sides of the vertical partition 510 and thus the extension partition 520 guides a relatively reduced amount of wash water.

Hereinafter, a flow of wash water through the distribution unit 360 will be described with reference to FIGS. 9 to 14.

Figure 9:
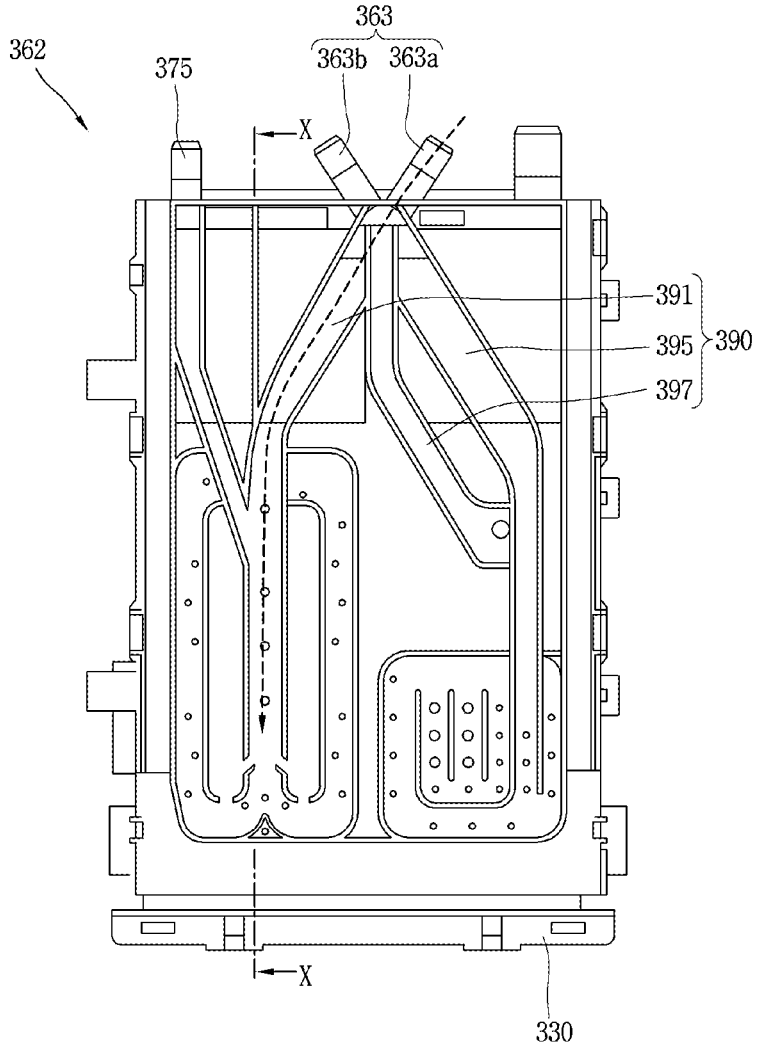
FIG. 9 is a view illustrating an operation of a main valve supply portion of the distribution unit body of FIG. 4.
Figure 10:
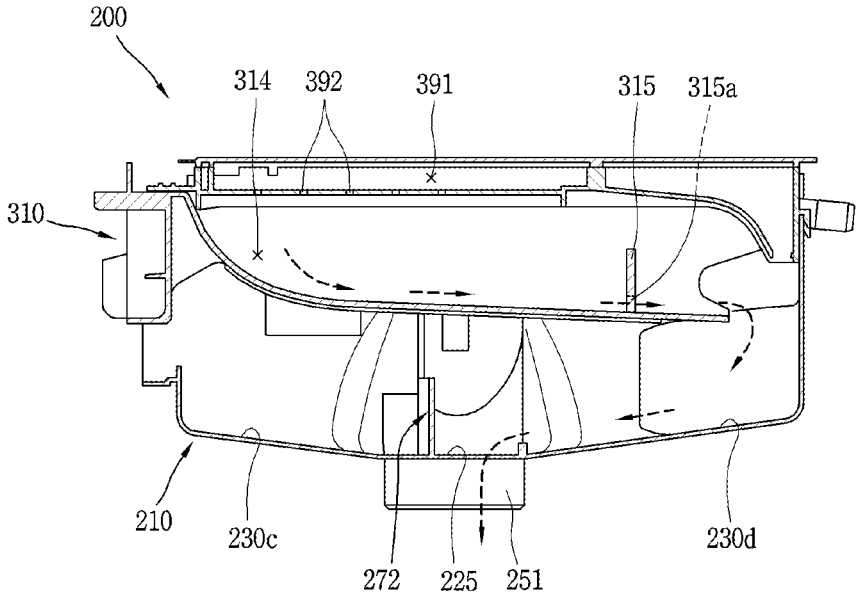
FIG. 10 is a cross-sectional view taken along the line X-X of FIG. 9.
Figure 11:
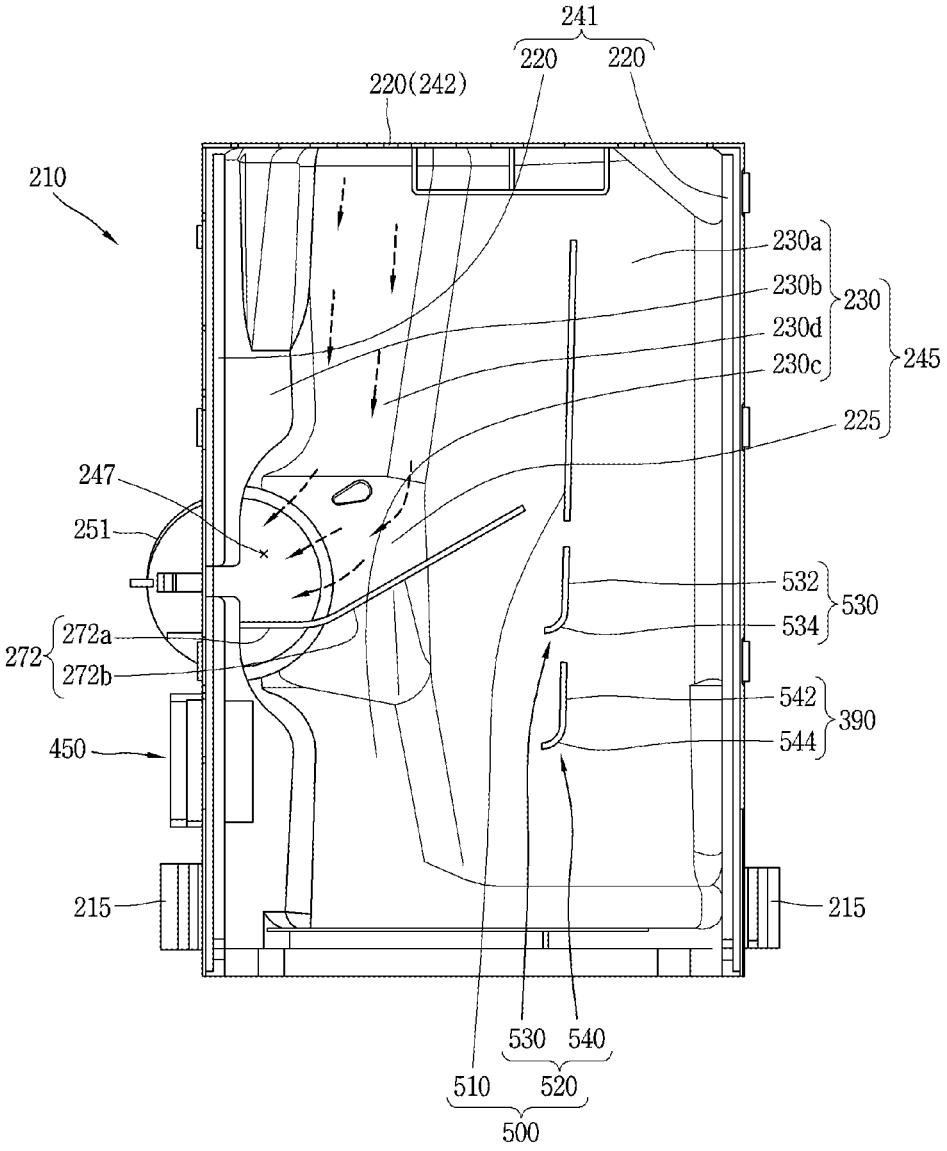
FIG. 11 is a view illustrating a flow of wash water passing through the main valve supply portion of FIG. 9.

FIG. 9 is a view illustrating an operation of the main valve supply portion 391 of the distribution unit body 362 of FIG. 4, FIG. 10 is a cross-sectional view taken along the line X-X of FIG. 9, and FIG. 11 is a view illustrating a flow of wash water passing through the main valve supply portion 391 of FIG. 9.

As illustrated in FIG. 9, when the main valve 369 is opened to open the main passage 365, wash water is moved into the main valve supply portion 391, and then dropped into the main detergent storage portion 314 of the drawer 310 through the distribution holes 392.

As illustrated in FIG. 10, the wash water passed through the main valve supply portion 391 is moved into the rear region of the main detergent storage portion 314 of the drawer 310, and thus dropped into the rear left region of the housing 210 in the drawing.

The wash water dropped to the rear of the housing 210 via the main detergent storage portion 314 of the drawer 310, as illustrated in FIG. 11, flows along the fourth inclined section 230*d* (rear inclined section) to be moved into the water tub 140 via the rear region of the through portion 247.

The horizontal partition 272 prevents the detergent and the wash water moved forward along the fourth inclined section 230*d* from being moved to the front region of the housing 210, thereby suppressing the detergent from remaining in the housing 210.

Figure 12:
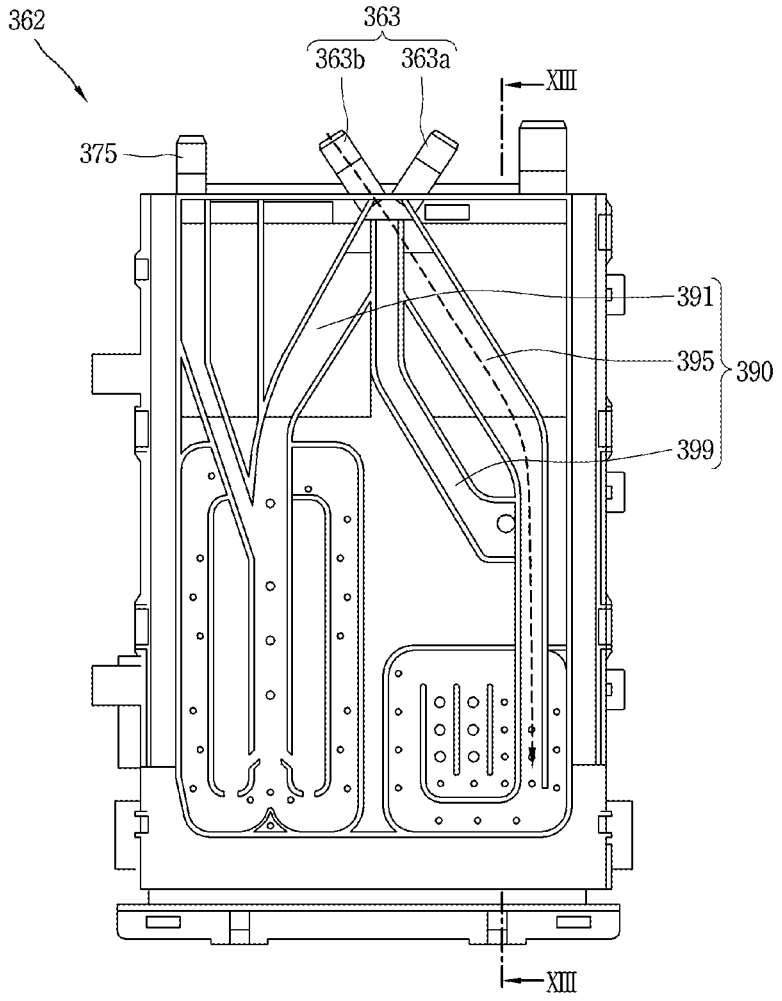
FIG. 12 is a view illustrating an operation of a pre-valve supply portion of the distribution unit body of FIG. 4.
Figure 13:
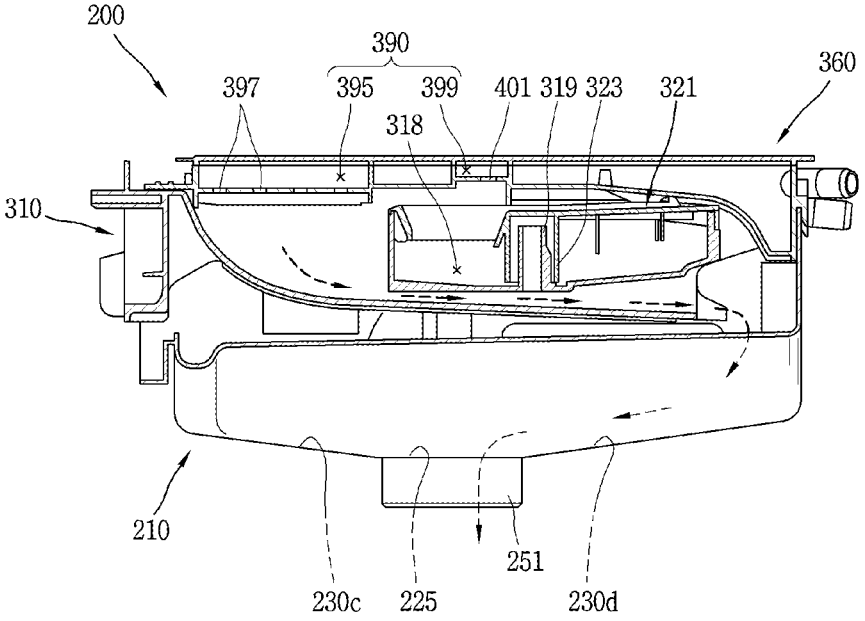
FIG. 13 is a cross-sectional view taken along the line XIII-XIII of FIG. 12.
Figure 14:
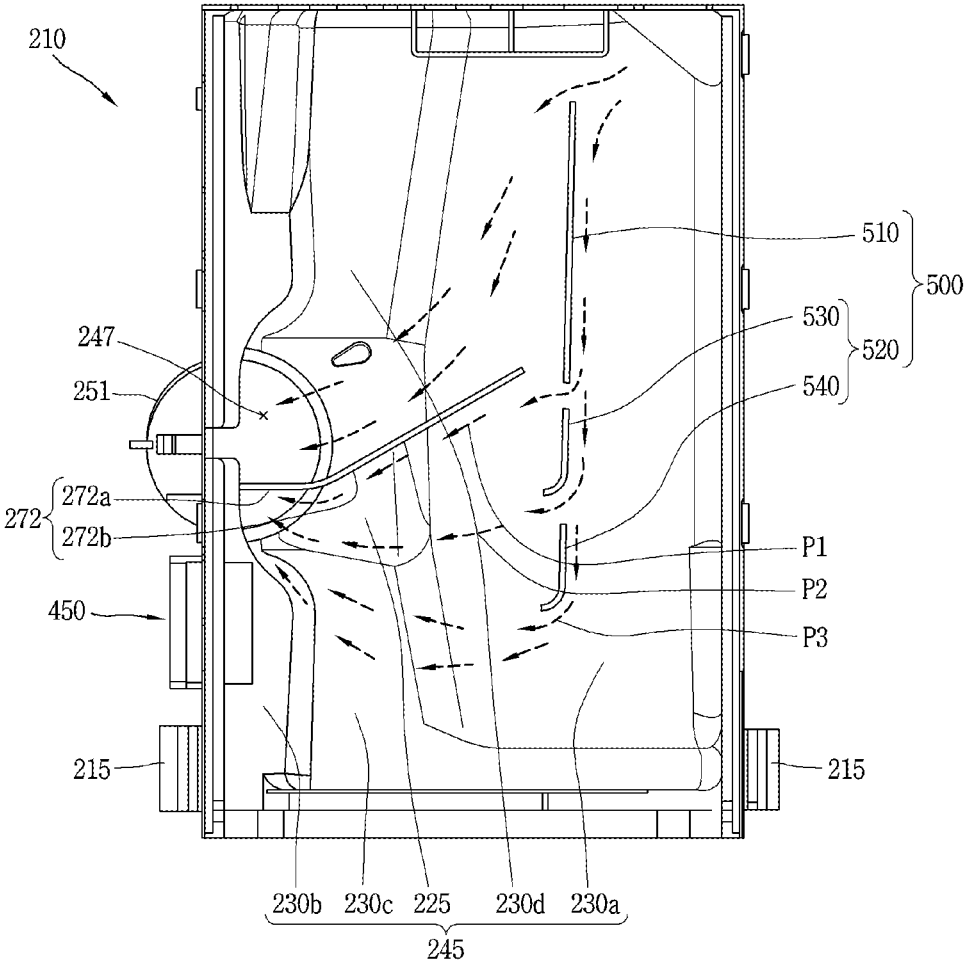
FIG. 14 is a view illustrating a flow of wash water passing through the pre-valve supply portion of FIG. 12.

FIG. 12 is a view illustrating an operation of the pre-valve supply portion 395 of the distribution unit body 362 of FIG. 4, FIG. 13 is a cross-sectional view taken along the line XIII-XIII of FIG. 12, and FIG. 14 is a view illustrating a flow of wash water passing through the pre-valve supply portion 395 of FIG. 12. As illustrated in FIG. 12, when the pre-valve 370 is opened, wash water is moved along the pre-passage 366 and then flows into the pre-valve supply portion 395 inside the distribution unit 360. The wash water moved to the pre-valve supply portion 395 is dropped into the drawer 310 through the distribution holes 397 formed through the bottom surface of the pre-valve supply portion 395.

The wash water passed through the pre-valve supply portion 395 is dropped into the pre-detergent storage portion 316 of the drawer 310. As illustrated in FIG. 13, the wash water dropped to the pre-detergent storage portion 316 is moved to the rear region of the pre-detergent storage portion 316 and dropped into the rear region of the housing 210. The wash water dropped via the pre-detergent storage portion 316 is dropped into the rear right region (first inclined section 230*a*) of the housing 210.

As illustrated in FIG. 14, the wash water dropped down to the rear of the housing 210 via the pre-detergent storage portion 316 is partially moved downward between the rear portion 242 of the housing 210 and the rear end portion of the vertical partition 510, so as to be introduced into the rear region of the horizontal partition 272. The wash water introduced to the rear of the horizontal partition 272 is supplied into the water tub 140 through the rear region of the through portion 247.

Part of the wash water dropped via the pre-detergent storage portion 316 is moved forward along the vertical partition 510. Part of the wash water moved along the vertical partition 510 is moved downward between the vertical partition 510 and the first extension partition 530, so as to form a first path P1 along the front region of the horizontal partition 272. Another part of the wash water moved along the vertical partition 510 is moved along the first extension partition 530, and then moved downward between the first extension partition 530 and the second extension partition 540, so as to form a second path P2 formed via a front region of the first path P1. In addition, another part of the wash water moved along the first extension partition 530 is moved to the front region of the second extension partition 540 and then moved downward, so as to form a third path P3 formed via the front region of the housing 210, namely, a front region of the second path P2.

Accordingly, the detergent remaining at the front of the horizontal partition 272 is washed off by the wash water moved along the first path P1, the second path P2, and the third path P3, thereby suppressing the detergent from remaining at the inner front region of the housing 210. In this exemplary embodiment, the first path P1, the second path P2, and the third path P3 are illustrated with arrows, respectively, but it will be understood that the first path P1, the second path P2, and the third path P3 are not formed to exactly coincide with the arrows shown in the drawing.

Figure 15:
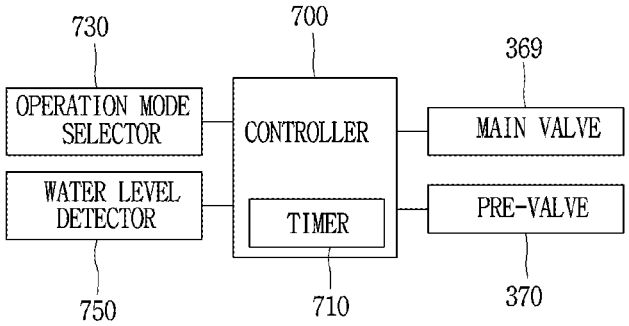
FIG. 15 is a control block diagram of the laundry treating apparatus of FIG. 1.

FIG. 15 is a control block diagram of the laundry treating apparatus of FIG. 1. As illustrated in FIG. 15, the laundry treating apparatus according to the exemplary embodiment includes a controller 700 having a control program and implemented as a microprocessor.

The controller 700 is configured to perform a first main-continuous supply process of continuously supplying wash water by opening the main valve 369 for a preset time, a pre-continuous supply process of continuously supplying the wash water by opening the pre-valve 370 for a preset time, and a second main-continuously supply process of continuously supplying the wash water by opening the main valve 369, and control each of the main valve 369 and the pre-valve 370 to supply the wash water to the detergent box 200 through the first main-continuously supply process, the pre-continuous supply process, and the second main-continuous supply process.

The controller 700 is connected to an operation mode selector 730 for selecting any one of a plurality of operation modes so as to perform communication with the operation mode selector 730.

The plurality of operation modes may include, for example, a first operation mode including the main-wash and the pre-wash.

The plurality of operation modes may include, for example, a second operation mode including the main-wash and not including the pre-wash.

The controller 700 may perform the first main-continuous supply process, the pre-continuous supply process, and the second main-continuous supply process, during the main-wash in the operation mode selected by the operation mode selector 730.

The controller 700 is controllably connected to the main valve 369 and the pre-valve 370, respectively.

The controller 700 is provided with a timer 710 for counting time.

The controller 700 is connected to a water level detector 750 for detecting a water level inside the water tub.

The first main-continuous supply process may be set such that the main valve 369 is opened for a first preset time or shorter. The first preset time may be, for example, set in consideration of a degree that the water level inside the drawer 310 rises as a speed of supplying the wash water becomes faster than a speed of discharging the wash water from the drawer 310 when pressure of the wash water is relatively high during the supply of the wash water into the drawer 310.

In this embodiment, the first preset time is set to 10 seconds or shorter. However, this is only illustrative and the present disclosure is not limited thereto.

Figure 16:
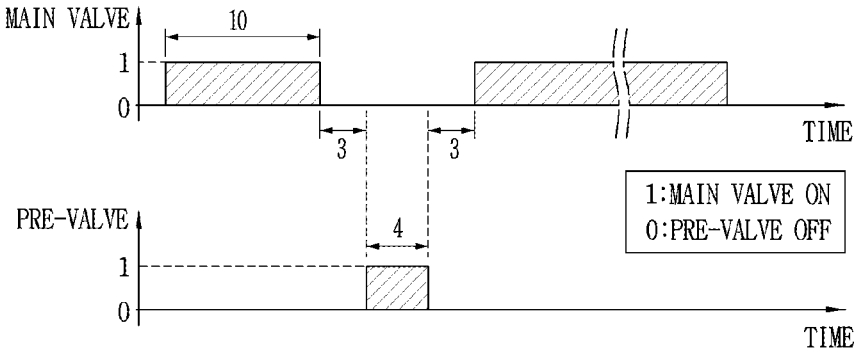
FIG. 16 is a view illustrating an opening and closing operation of a main valve and a pre-valve of a laundry treating apparatus according to one embodiment.

FIG. 16 is a view illustrating an opening and closing operation of the main valve 369 and the pre-valve 370 of the laundry treating apparatus according to the one embodiment. As illustrated in FIG. 16, the controller 700 may control the main valve 369 and the pre-valve 370 so that the pre-continuous supply process is performed a preset waiting time after the end of the first main-continuous supply process.

The controller 700 may also control the main valve 369 and the pre-valve 370 such that the second main-continuous supply process is performed a preset waiting time after the end of the pre-continuous supply process.

The controller 700 detects the water level of the water tub 140 through the water level detector 750 during the second main-continuous supply process, and controls the main valve 369 to close the main passage 365 when the water level of the water tub 140 reaches a preset water level.

Figure 17:
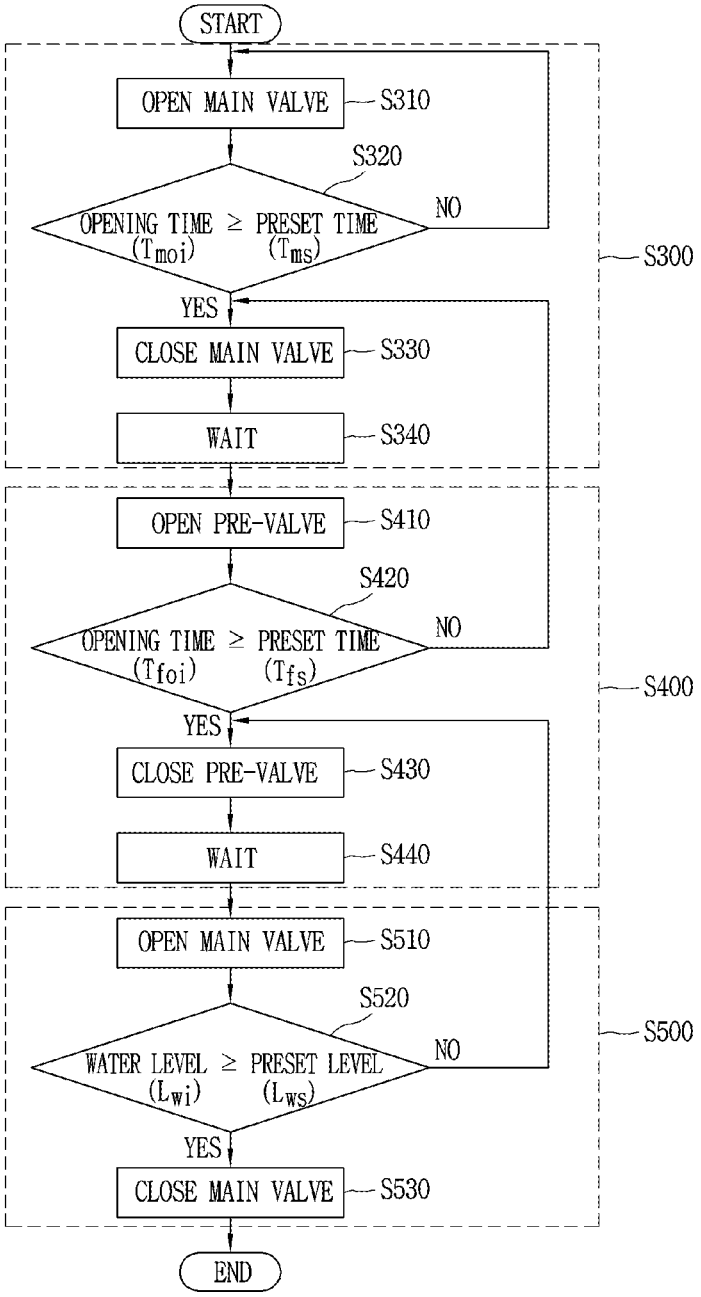
FIG. 17 is a view illustrating a water supply control method of a laundry treating apparatus in accordance with one embodiment.

FIG. 17 is a view illustrating a water supply control method of a laundry treating apparatus in accordance with one embodiment. As illustrated in FIG. 17, a water supply control method of a laundry treating apparatus according to one embodiment includes performing a first main-continuous supply process of continuously supplying wash water by opening the main valve 369 for a preset time (S300), performing a pre-continuous supply process of continuously supplying wash water by opening the pre-valve 370 for a preset time (S400), and performing a second main-continuous supply process of continuously supplying wash water by opening the main valve 369 for a preset time (S500).

When main-wash is started, the controller 700 controls the main valve 369 to be opened so that the wash water can be supplied to the detergent box 200 through the main passage 365 (S310). The controller 700 counts an opening time Tmoi of the main valve 369 by the timer 710. When the opening time Tmoi of the main valve 369 reaches a preset time Tms (S320), the controller 700 closes the main valve 369 (S330).

The controller 700 waits for a preset waiting time after the main valve 369 is closed (S340). The controller 700 performs the pre-continuous supply process when the waiting time elapses (S400).

First, the controller 700 opens the pre-valve 370 (S410). Accordingly, the wash water is supplied to the detergent box 200 through the pre-passage 366.

Here, the wash water supplied to the detergent box 200 through the pre-passage 366 is dropped into the housing 210 via the pre-detergent storage portion 316. In this case, when detergent is wrongly introduced into the pre-detergent storage portion 316 due to user's carelessness, the detergent of the pre-detergent storage portion 316 may be moved into the water tub 140 by the wash water supplied to the detergent box 200 through the pre-passage 366.

The wash water dropped into the housing 210 is moved to the through portion 247 while forming the plurality of water movement paths at the front region of the horizontal partition 272 by the wash water guide unit 500. Accordingly, the detergent remaining at the front region of the horizontal partition 272 is washed off by the wash water moved along the plurality of wash water movement paths, thereby suppressing the detergent from remaining at the inner front region of the housing 210.

The controller 700 counts an opening time Tfoi of the pre-valve 370 by the timer 710. When the opening time Tfoi of the pre-valve 370 reaches a preset time Tfs (S420), the controller 700 controls the pre-valve 370 to be closed (S430). The controller 700 waits for a preset time when the pre-valve 370 is closed (S440). The controller 700 counts a waiting time by the timer 710. When the waiting time reaches a preset time, the controller 700 controls the main valve 369 to be opened (S510) so that the main-continuous supply process is performed (S500).

The controller 700 detects the water level of the wash water inside the water tub 140 through the water level detector 750. When the detected water level Lwi in the water tub 140 reaches a preset water level Lws (S520), the controller controls the main valve 369 to be closed (S530).

Figure 18:
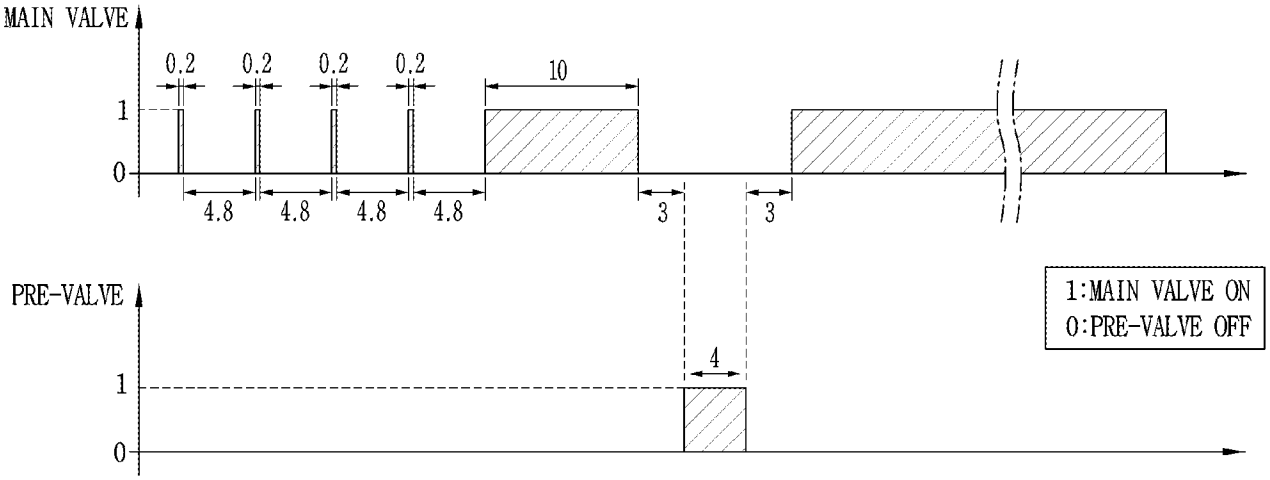
FIG. 18 is a view illustrating an opening and closing operation of a main valve and a pre-valve of a laundry treating apparatus according to another embodiment.

FIG. 18 is a view illustrating an opening and closing operation of the main valve 369 and the pre-valve 370 of the laundry treating apparatus according to another embodiment. As illustrated in FIG. 18, the controller 700 of the laundry treating apparatus in this embodiment performs a main-intermittent supply process, a first main-continuous supply process, a pre-continuous supply process, and a second main-continuous supply process.

The main-intermittent supply process is configured to intermittently open and close the main valve 369 to intermittently supply wash water of the main passage 365 to the detergent box 200 before the first main-continuous supply process.

Here, opening and closing the main valve 369 intermittently means repeating an operation of opening and closing the main valve 369 a predetermined number of times at a relatively short time interval.

When the wash water is intermittently supplied into the detergent box 200, clumped detergent of the detergent (washing powder) supplied to the main detergent storage portion 314 of the detergent box 200 is split by the wash water into small grains or its original powder form.

This may facilitate the movement of the detergent by the wash water, thereby suppressing the detergent residue in the detergent box 200.

Here, if washing powder is clumped in a relatively big size in the main detergent storage portion 314 of the detergent box 200, the clumped detergent is pushed to a region out of a movement path of wash water without being moved along with the wash water and remains in the region. The clumped detergent pushed out of the movement path of the wash water is hardened due to being wetted with the wash water, and the hardened detergent interferes with the flow of wash water and detergent. This problem is solved through the main-intermittent supply process and/or a pre-intermittent supply process to be described later performed in the laundry treating apparatus according to the one embodiment of the present disclosure.

In addition, when the wash water is intermittently supplied to the inside of the detergent box 200, a relatively small amount of wash water first comes into contact with the detergent (main detergent) inside the main detergent storage portion 314. The detergent brought into contact with the wash water is combined with the water to be relatively increased in specific gravity, which may suppress the detergent from being scattered and/or floated during spraying of the wash water. Here, the scattered and/or floated detergent during the spraying of the wash water is stuck on regions, which the wash water is relatively difficult to reach, of inner surfaces of the detergent box 200, and remains in the detergent box 200.

In the step of performing the main-intermittent supply process, the controller 700 repeats a process of opening the main valve 369 for a main-intermittent opening time and closing the main valve 369 for a main-intermittent closing time by a preset main-intermittent opening and closing frequency (i.e., a preset number of times of intermittently opening and closing the main valve 369).

The main-intermittent opening time may be set in the range of 0.15 to 0.25 seconds.

The main-intermittent opening time may preferably be 0.2 seconds.

The main-intermittent closing time may be set in the range of 3.6 to 6 seconds.

The main-intermittent closing time may preferably be 4.8 seconds.

The preset main-intermittent opening and closing frequency may preferably be 4 times.

With this configuration, the controller 700 controls the main valve 369 such that the main-intermittent supply process is performed during the main-wash. Accordingly, the clumped detergent, of the main detergent inside the main detergent storage portion 314 can be split into small grains so as to be easily moved along with the wash water, thereby suppressing the detergent residue in the detergent box 200. In addition, the main detergent inside the main detergent storage portion 314 can be brought into contact with a relative small amount of wash water and combined with the wash water. This may allow the process of suppressing scattering and/or floating of the detergent to be repeated a preset number of times, thereby suppressing the detergent residue in the detergent box 200 due to the scattered or floated detergent.

Figure 19A:
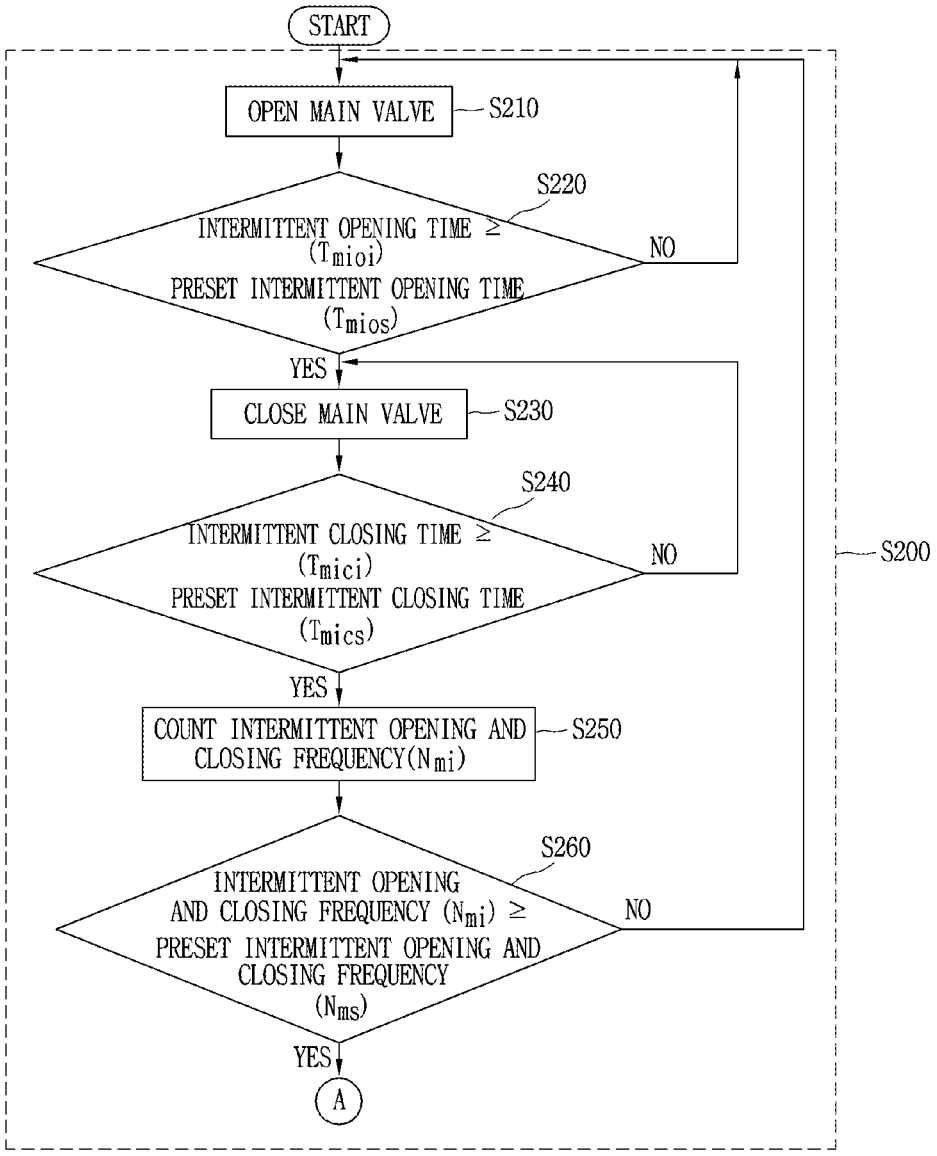
FIG. 19A is a view illustrating a main-intermittent supply process of a water supply control method of a laundry treating apparatus in accordance with another embodiment.
Figure 19B:
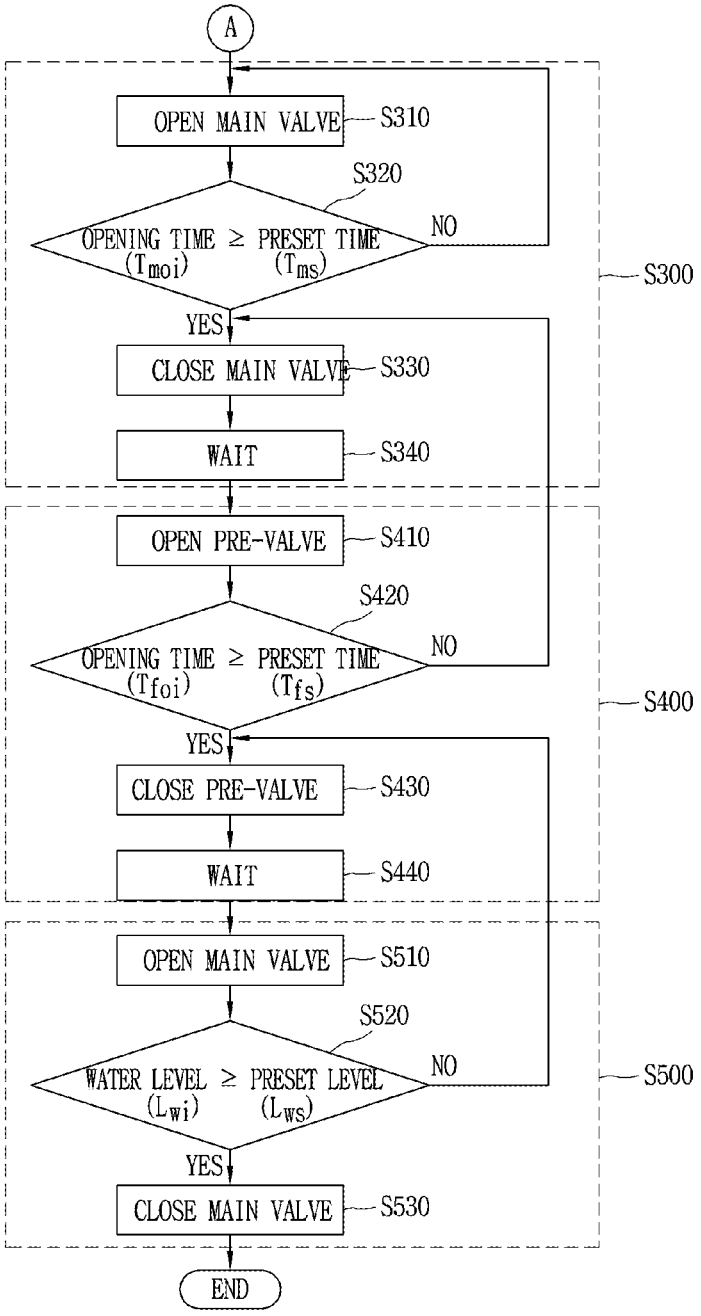
FIG. 19B is a view illustrating steps after a main-intermittent supply process of a water supply control method of a laundry treating apparatus according to another embodiment.

FIG. 19A is a view illustrating a main-intermittent supply process of the water supply control method of the laundry treating apparatus in accordance with another embodiment, and FIG. 19B is a view illustrating steps after the main-intermittent supply process of the water supply control method of the laundry treating apparatus according to the another embodiment. As illustrated in FIGS. 19A and 19B, a water supply control method of the laundry treatment apparatus according to this embodiment includes performing a main-intermittent supply process (S200), performing a first main-continuous supply process (S300), performing a pre-continuous supply process (S400), and performing a second main-continuous supply process (S500).

During the main-intermittent supply process (S200), the controller 700 controls the main valve 369 to be opened so that the wash water can be supplied to the detergent box 200 through the main passage 365 (S210).

The controller 700 counts an intermittent opening time Tmioi of the main valve 369 by the timer 710. When the intermittent opening time Tmioi reaches a preset intermittent opening time Tmios (S220), the controller 700 closes the main valve 369 (S230).

The controller 700 counts an intermittent closing time Tmici of the main valve 369 by the timer 710. When the intermittent closing time Tmici reaches a preset intermittent closing time Tmics (S240), the controller 700 counts an intermittent opening and closing frequency Nmi (intermittent closing frequency of the main valve 369, namely, a number of times of intermittently closing the main valve 369) (S250).

The controller 700 repeats those processes until the intermittent opening and closing frequency Nmi reaches a preset intermittent opening and closing frequency Nms (S260).

The controller 700 opens the main valve 369 for 0.3 seconds and closes it for 4.7 seconds in the step S200 of performing the main-intermittent supply process.

More specifically, when the main valve 369 is opened, the main passage 365 is opened for 0.3 seconds, and the wash water is supplied to the main detergent storage portion 314. The wash water supplied to the main detergent storage portion 314 is in contact with the detergent inside the main detergent storage portion 314. During this, the clumped detergent is split into small grains by the sprayed wash water so as to be easily moved along with the wash water. In addition, the detergent in contact with the wash water is combined (wet) with the wash water and thusly increased in specific gravity, thereby being prevented from being scattered and/or floated. This may result in suppressing the detergent residue in the detergent box 200.

When the intermittent opening and closing frequency reaches the preset intermittent opening and closing frequency (S260), the controller 700 controls the main valve 369 and the pre-valve 370 to perform the first main-continuous supply process (S300), perform the pre-continuous supply process (S400), and perform the second main-continuous supply process S(500).

This may result in suppressing the detergent residue in the detergent box 200.

Figure 20:
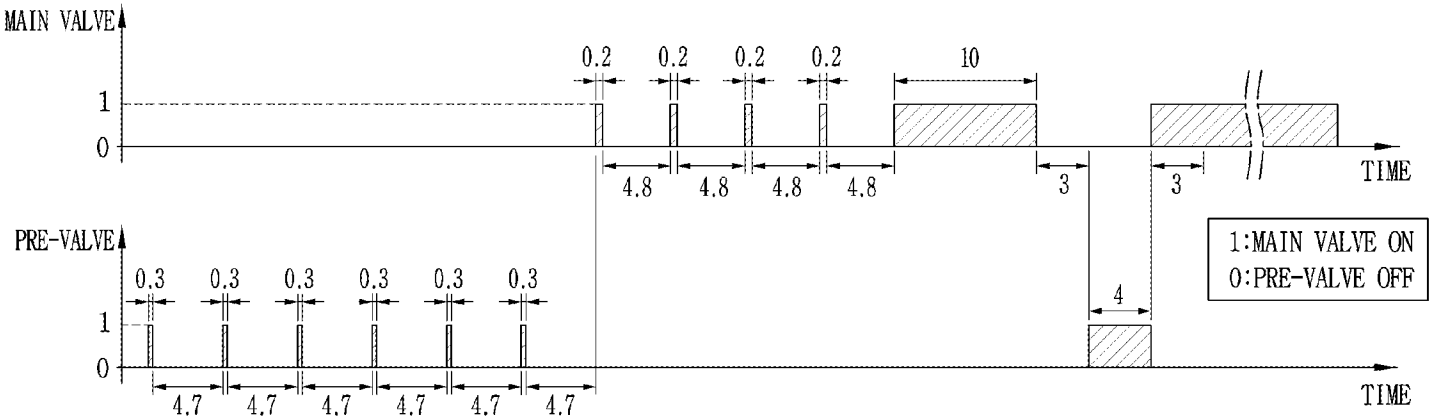
FIG. 20 is a view illustrating a switching operation of a main valve and a pre-valve of a laundry treating apparatus according to still another embodiment.

FIG. 20 is a view illustrating an opening and closing operation of the main valve and the pre-valve of the laundry treating apparatus according to still another embodiment.

The controller 700 of the laundry treating apparatus in this embodiment includes a pre-intermittent supply process, a main-intermittent supply process, a first main-continuous supply process, a pre-continuous supply process, and a second main-continuous supply process.

The pre-intermittent supply process is configured to intermittently open and close the pre-valve 370 to supply wash water of the pre-passage 366 to the detergent box 200 intermittently before the main-intermittent supply process.

Here, opening and closing the pre-valve 370 intermittently means repeating an operation of opening and closing the pre-valve 369 a predetermined number of times at a relatively short time interval.

When the wash water is intermittently supplied into the detergent box 200, clumped detergent of the detergent (washing powder) supplied to the pre-detergent storage portion 316 of the detergent box 200 is split by the wash water into small grains or its original powder form.

This may facilitate the movement of the detergent by the wash water, thereby suppressing the detergent residue in the detergent box 200.

In addition, when the wash water is intermittently supplied to the inside of the detergent box 200, a relatively small amount of wash water first comes into contact with detergent (pre-detergent) in the pre-detergent storage portion 316, and the detergent is prevented from being scattered and/or floated, thereby suppressing the detergent residue in the detergent box 200.

During the pre-intermittent supply process, the controller 700 repeats the process of opening the pre-valve 370 for a pre-intermittent opening time and closing the pre-valve 370 for a pre-intermittent closing time by a preset pre-intermittent opening and closing frequency.

The pre-intermittent opening time may be set in the range of 0.25 to 0.35 seconds.

The pre-intermittent opening time may preferably be 0.3 seconds.

The pre-intermittent closing time may be set in the range of 3.92 to 5.48 seconds.

The pre-intermittent closing time may preferably be 4.7 seconds.

The pre-intermittent opening and closing frequency may preferably be six times.

With this configuration, the controller 700 controls the pre-valve 370 such that the pre-intermittent supply process is performed during the main wash. Accordingly, clumped detergent, of the pre-detergent inside the pre-detergent storage portion 316 can be split into small grains so as to be easily moved along with the wash water, thereby suppressing the detergent residue in the detergent box 200. In addition, the pre-detergent inside the pre-detergent storage portion 316 may first be in contact with the relatively small amount of wash water, which may be repeated by a preset number of times. Accordingly, the detergent can be prevented from being scattered and/or floated, thereby suppressing the detergent residue in the detergent box 200.

Figure 21A:
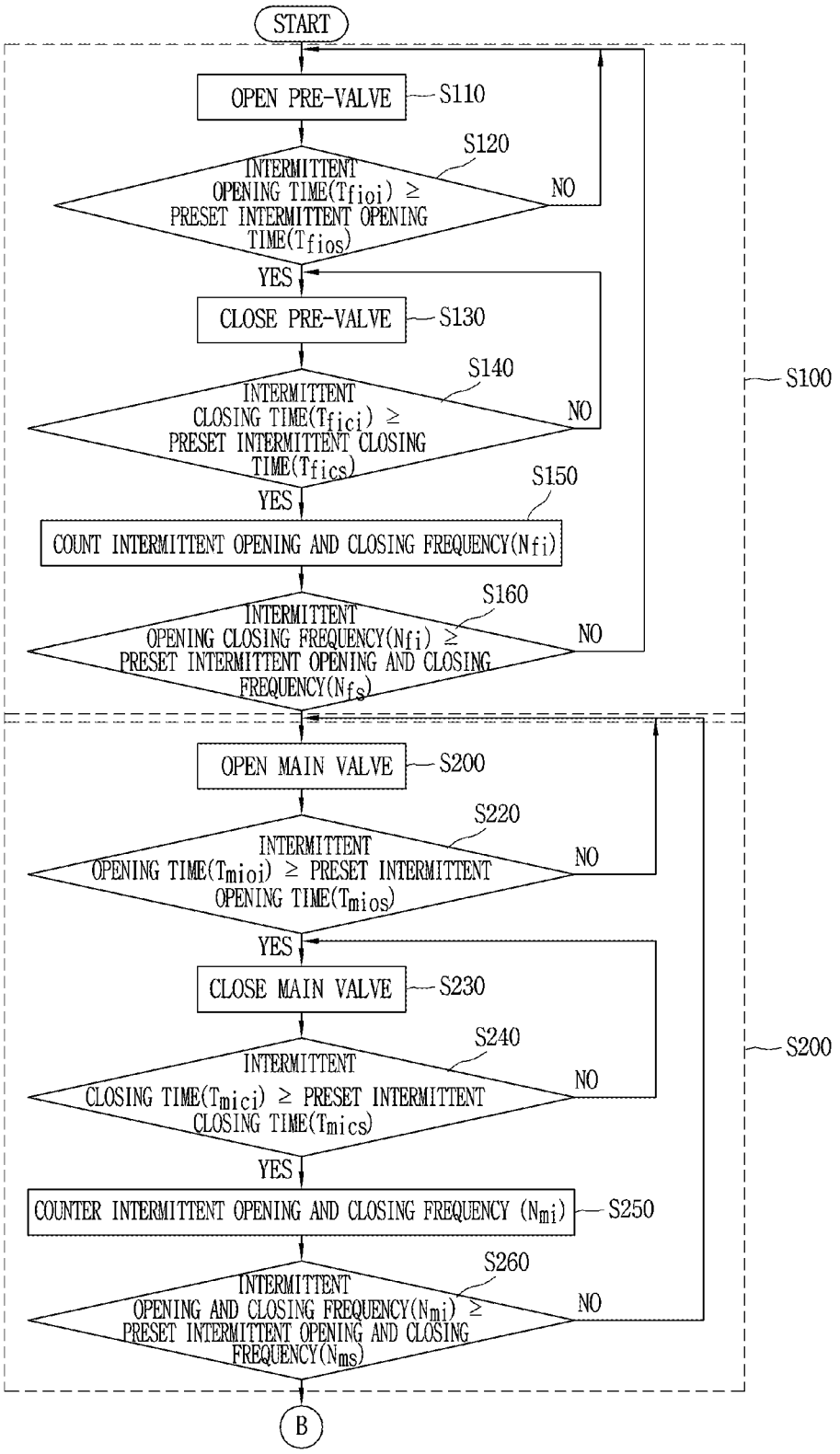
FIG. 21A is a view illustrating a pre-intermittent supply process of a water supply control method of a laundry treating apparatus in accordance with still another embodiment.
Figure 21B:
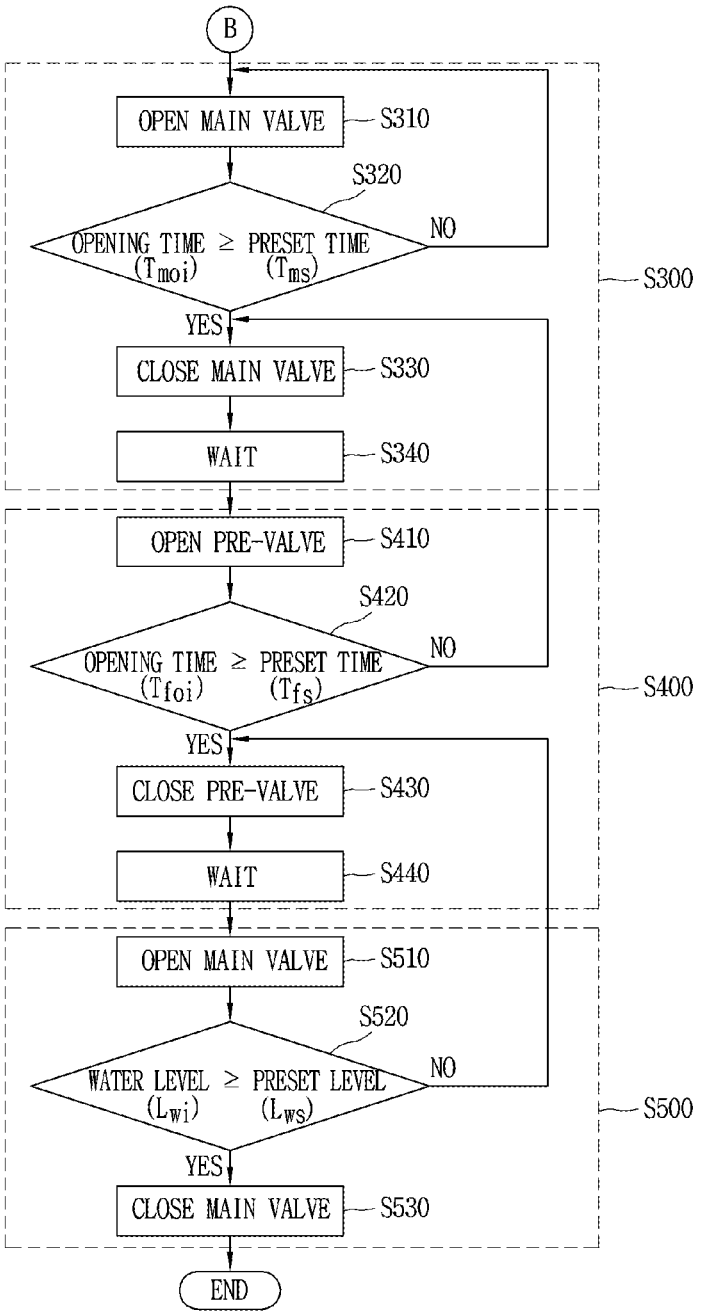
FIG. 21B is a view illustrating steps after the pre-intermittent supply process of the water supply control method of the laundry treating apparatus according to the still another embodiment.

FIG. 21A is a view illustrating a pre-intermittent supply process of the water supply control method of the laundry treating apparatus in accordance with still another embodiment, and FIG. 21B is a view illustrating steps after the pre-intermittent supply process of the water supply control method of the laundry treating apparatus according to the still another embodiment. As illustrated in FIGS. 21A and 21B, a water supply control method of the laundry treatment apparatus according to this embodiment includes performing a pre-intermittent supply process (S100), performing a main-intermittent supply process (S200), performing a first main-continuous supply process (S300), performing a pre-continuous supply process (S400), and performing a second main-continuous supply process (S500).

During the pre-intermittent supply process (S100), the controller 700 controls the pre-valve 370 to be opened so that wash water can be supplied to the detergent box 200 through the pre-passage 366 (S110). The controller 700 counts an intermittent opening time Tfioi of the pre-valve 370 by the timer 710. When the intermittent opening time Tfioi reaches a preset intermittent opening time Tfios (S120), the controller 700 closes the pre-valve 370 (S130). The controller 700 counts an intermittent closing time Tfici of the pre-valve 370 by the timer 710. When the intermittent closing time Tfici reaches a preset intermittent closing time Tfics (S140), the controller 700 counts an intermittent opening and closing frequency Nfi (intermittent closing frequency) of the pre-valve 370 (S150).

The controller 700 performs the pre-intermittent supply process by repeating the above processes until the intermittent opening and closing frequency Nfi reaches the preset intermittent opening and closing frequency Nfs (S160).

The controller 700 opens the pre-valve 370 for 0.2 seconds and closes it for 4.8 seconds in the step S100 of performing the pre-intermittent supply process (S100). The controller 700 repeats six times the process of opening the pre-valve 370 for 0.2 seconds and closing it for 4.8 seconds.

More specifically, when the pre-valve 370 is opened, the pre-passage 366 is opened for 0.2 seconds, and a relatively small amount of wash water supplied to the pre-detergent storage portion 316 is brought into contact with the detergent inside the pre-detergent storage portion 316. At this time, clumped detergent of the pre-detergent is split into small grains so as to be easily moved along with the wash water. In addition, the pre-detergent in contact with the wash water is combined with the wash water so as to be increased in specific gravity, thereby being prevented from being scattered and/or floated. This may result in suppressing the detergent residue in the detergent box 200.

When the intermittent opening and closing frequency Nfi reaches the preset intermittent opening and closing frequency Nfs (S160), the controller 700 controls the main valve 369 to perform the main-intermittent supply process (S200).

When the main-intermittent supply process is performed, the wash water passed through the main passage 365 flows into the main detergent storage portion 314 and clumped detergent of the main detergent is split into small grains so as to be easily moved along with the wash water. Also, scattering and/or floating of the main detergent is prevented through the process of supplying the relatively small amount of wash water a preset number of times (four times). This may result in suppressing the detergent residue in the detergent box 200.

When the main-intermittent supply process (S200) is completed, the controller 700 controls the main valve 369 to perform the first main-continuous supply process (S300).

Since the detergent has been split into the small grains to be easily moved while performing the main-intermittent supply process, and the main detergent has been in contact and combined with the wash water through the process of supplying the small amount wash water by the main-intermittent opening and closing frequency for the main-intermittent opening time, the detergent residue in the detergent box 200 can be suppressed and the smooth supply of the main detergent can be achieved during the first main-continuous supply process.

When the first main-continuous supply process (S300) is completed, the controller 700 controls the pre-valve 370 to perform the pre-continuous supply process (S400). During the pre-continuous supply process, the residual detergent at the front region of the horizontal partition 272 inside the housing 210, which may be generated in the first main-continuous supply process, can be washed off by the wash water which is guided by the wash water guide unit 500 so as to be moved along the plurality of wash water movement paths. This may result in suppressing the detergent residue at the inner front region of the detergent box 200.

When the pre-intermittent supply process (S400) is completed, the controller 700 opens the main valve 369 to perform the second main-continuous supply process (S500). During the second main-continuous supply process, the controller 700 detects the water level of the wash water in the water tub 140 through the water level detector 750 and opens the main valve 369 until the water level Lwi of the wash water in the water tub 140 reaches a preset water level Lws. The controller 700 controls the main valve 369 to block the main passage 365 when the water level Lwi of the wash water reaches the preset water level Lws.

The foregoing description has been given of specific embodiments of the present disclosure. However, the present disclosure may be embodied in various forms without departing from the spirit or essential characteristics thereof, and thus the above-described embodiments should not be limited by the details of the detailed description.

In addition, even embodiments not listed in the detailed description should be interpreted within the scope of the technical idea defined in the appended claims. It is intended that the present disclosure cover the modifications and variations of this disclosure provided they come within the scope of the appended claims and their equivalents.

What is claimed is:

1. A laundry treating apparatus, comprising:

a cabinet;

a water tub disposed inside the cabinet;

a detergent box connected to the water tub and configured to supply detergent to the water tub, the detergent box having a plurality of wash water movement paths defined therein;

a main passage connected to one of the plurality of wash water movement paths and configured to supply wash water to the detergent box;

a main valve disposed at the main passage;

a pre-passage connected to another of the plurality of wash water movement paths and configured to supply wash water to the detergent box;

a pre-valve disposed at the pre-passage; and a controller configured to:

perform a first main-continuous supply process comprising supplying wash water by opening the main valve for a first preset time, based on performance of the first main-continuous supply process, perform a pre-continuous supply process comprising supplying wash water by opening the pre-valve for a second preset time, based on performance of the pre-continuous supply process, perform a second main-continuous supply process comprising supplying wash water by opening the main valve, and control each of the main valve and the pre-valve to supply wash water to the detergent box through the first main-continuously supply process, the pre-continuous supply process, and the second main-continuous supply process, perform a main-intermittent supply process comprising intermittently opening and closing the main valve to thereby intermittently supply wash water through the main passage to the detergent box before performing the first main-continuous supply process, and wherein the main-intermittent supply process comprises:

based on a preset main-intermittent opening and closing frequency, repeating opening the main valve for a main-intermittent opening time and closing the main valve for a main-intermittent closing time.

2. The apparatus of claim 1, wherein the main-intermittent opening time is in a range from 0.15 to 0.25 seconds, and wherein the main-intermittent closing time is in a range from 3.6 to 6 seconds.

3. The apparatus of claim 1, wherein the controller further configured to, before performing the main-intermittent supply process, perform a pre-intermittent supply process comprising intermittently opening and closing the pre-valve to thereby intermittently supply wash water through the pre-passage to the detergent box.

4. The apparatus of claim 3, wherein the pre-intermittent supply process comprises:

based on a preset pre-intermittent opening and closing frequency, repeating opening the pre-valve for a pre-intermittent opening time and closing the pre-valve for a pre-intermittent closing time.

5. The apparatus of claim 4, wherein the pre-intermittent opening time is in a range from 0.25 to 0.35 seconds, and wherein the pre-intermittent closing time is in a range from 3.92 to 5.48 seconds.

6. The apparatus of claim 1, wherein the first main-continuous supply process comprises opening the main valve for an opening time that is set to 10 seconds or shorter.

7. The apparatus of claim 1, wherein the detergent box comprises:

a housing connected to the water tub;

a drawer configured to be received in the housing, the drawer having a plurality of detergent accommodation spaces defined therein; and a distribution unit disposed vertically above the drawer and connected to the main passage and the pre-passage, and wherein the housing comprises:

a through portion defined at a surface of the housing and configured to communicate with the water tub, a horizontal partition that protrudes upward from the surface of the housing, that extends vertically above the through portion, and that extends horizontally across a front-rear direction of the housing, and a wash water guide unit that protrudes from the surface of the housing, that is spaced apart from the horizontal partition, and that extends in the front-rear direction of the housing, the wash water guide unit defining the plurality of wash water movement paths at a front region of the horizontal partition and being configured to guide, to the through portion, wash water supplied via the pre-passage along the plurality of wash water movement paths.

8. The apparatus of claim 7, wherein the pre-continuous supply process comprises opening the pre-valve for an opening time that is set according to a duration for which wash water passes through the drawer and reaches the through portion along the wash water guide unit.

9. A method for controlling water supply of a laundry treating apparatus, the laundry treating apparatus comprising a cabinet, a water tub disposed inside the cabinet, a detergent box connected to the water tub and configured to supply detergent to the water tub, the detergent box having a plurality of wash water movement paths defined therein, a main passage connected to one of the plurality of wash water movement paths and configured to supply wash water, a main valve disposed at the main passage, a pre-passage connected to another of the plurality of wash water movement paths and configured to supply wash water, and a pre-valve disposed at the pre-passage, the method comprising:

performing a main-intermittent supply process comprising intermittently supplying wash water through the main passage to the detergent box by intermittently opening and closing the main valve;

after performing the main-intermittent supply process, performing a first main-continuous supply process comprising supplying wash water by opening the main valve for a first preset time;

based on performance of the first main-continuous supply process, performing a pre-continuous supply process comprising supplying wash water by opening the pre-valve for a second preset time; and based on performance of the pre-continuous supply process, performing a second main-continuous supply process comprising supplying wash water by opening the main valve, wherein performing the main-intermittent supply process comprises:

based on a preset main-intermittent opening and closing frequency, repeating opening the main valve for a main-intermittent opening time and closing the main valve for a main-intermittent closing time.

10. The method of claim 9, further comprising:

before performing the main-intermittent supply process, performing a pre-intermittent supply process comprising intermittently supplying wash water through the pre-passage to the detergent box by intermittently opening and closing the pre-valve.

11. The method of claim 10, wherein performing the pre-intermittent supply process comprises:

based on a preset pre-intermittent opening and closing frequency, repeating opening the pre-valve for a pre-intermittent opening time and closing the pre-valve for a pre-intermittent closing time.

12. The method of claim 11, wherein the main-intermittent opening time is shorter than the main-intermittent closing time.

13. The method of claim 11, wherein the pre-intermittent opening time is shorter than the pre-intermittent closing time.

14. The method of claim 11, wherein the main-intermittent opening time is shorter than the pre-intermittent opening time.

15. The method of claim 11, wherein the preset pre-intermittent opening and closing frequency is greater than the preset main-intermittent opening and closing frequency.

16. The method of claim 9, further comprising:

waiting for a first preset waiting time between performance of the first main-continuous supply process and performance of the pre-continuous supply process; and waiting for a second preset waiting time between performance of the pre-continuous supply process and performance of the second main-continuous supply process.

* * * * *